US008115122B2

(12) United States Patent
Machida et al.

(10) Patent No.: US 8,115,122 B2
(45) Date of Patent: Feb. 14, 2012

(54) PUSH BUTTON SWITCH

(75) Inventors: Noriyoshi Machida, Konosu (JP); Mitsuo Nishio, Gyoda (JP); Takehisa Takeuchi, Chihibu (JP); Shinichi Sato, Chichibu (JP); Eijiro Shimoyama, Chichibu (JP)

(73) Assignee: Fuji Electric Fa Components & Systems Co., Ltd. (JP)

( * ) Notice: Subject to any disclaimer, the term of this patent is extended or adjusted under 35 U.S.C. 154(b) by 186 days.

(21) Appl. No.: 12/606,627

(22) Filed: Oct. 27, 2009

(65) Prior Publication Data

US 2010/0243418 A1 Sep. 30, 2010

(30) Foreign Application Priority Data

Oct. 27, 2008 (JP) ..... 2008-275617
Mar. 3, 2009 (JP) ..... 2009-049555
Aug. 28, 2009 (JP) ..... 2009-198859

(51) Int. Cl.
*H01H 27/00* (2006.01)

(52) U.S. Cl. ..... 200/43.07; 200/16 A; 200/43.04; 200/334

(58) Field of Classification Search ..... 200/16 R–16 D, 200/43.01, 43.02, 43.04, 43.07–43.09, 50.06, 200/520, 533, 534, 293, 303, 307, 334, 318, 200/318.1, 318.2, 330, 331
See application file for complete search history.

(56) References Cited

U.S. PATENT DOCUMENTS

| | | | | |
|---|---|---|---|---|
| 4,064,381 | A * | 12/1977 | Mullen et al. | 200/16 A |
| 4,282,414 | A * | 8/1981 | Johnston et al. | 200/519 |
| 6,072,128 | A * | 6/2000 | Ansorge et al. | 200/5 R |
| 6,114,639 | A * | 9/2000 | Hall et al. | 200/16 A |
| 6,198,058 | B1 * | 3/2001 | Graninger et al. | 200/50.02 |
| 6,288,352 | B1 | 9/2001 | Fukui et al. | |
| 7,232,965 | B2 * | 6/2007 | Gibbons et al. | 200/17 R |
| 7,781,687 | B2 * | 8/2010 | Scherl et al. | 200/43.07 |
| 7,786,398 | B2 * | 8/2010 | Olbrich et al. | 200/334 |
| 7,943,872 | B2 * | 5/2011 | Scherl | 200/43.04 |
| 8,003,909 | B2 * | 8/2011 | Gessler | 200/334 |

FOREIGN PATENT DOCUMENTS

| | | | |
|---|---|---|---|
| JP | 2001-035302 | A | 2/2001 |
| JP | 2003-303527 | A | 10/2003 |
| JP | 2007-115703 | B1 | 5/2007 |
| WO | 98/49701 | A1 | 11/1998 |

* cited by examiner

*Primary Examiner* — Michael Friedhofer
(74) *Attorney, Agent, or Firm* — Rossi, Kimms & McDowell LLP

(57) ABSTRACT

An operation portion and a switch portion of a push button switch are removably coupled. The switch portion includes a contact opening mechanism having a rotatably supported lever and a spring. The lever has one end acting on a part of the operation portion coupled with the switch portion, and the other end acting on a contact switching mechanism of the switching contact unit in the switch portion to open/close the contacts. The spring urges the lever in a fixed rotation direction. The contact switching mechanism is urged to move a movable contact from a standby state position toward an operating state position by the contact opening mechanism when the switch portion is separated from the operation portion. The contact switching mechanism is released from the urging when the switch portion is coupled with the operation portion.

13 Claims, 31 Drawing Sheets

FIG. 6
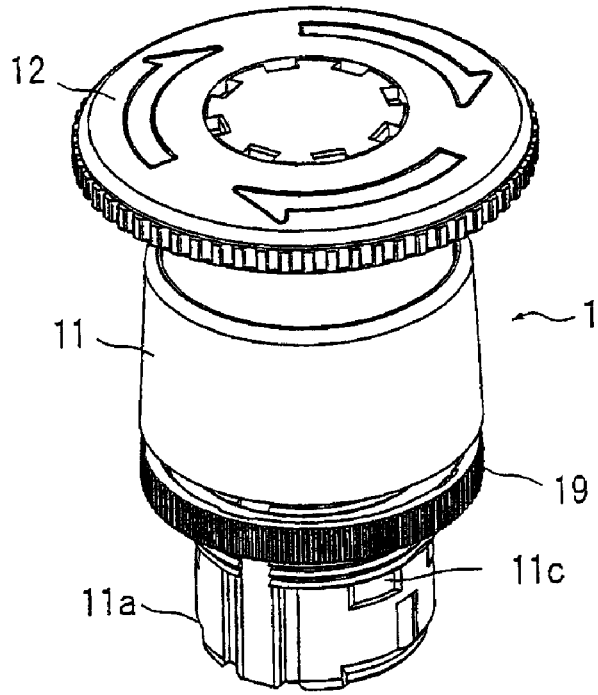
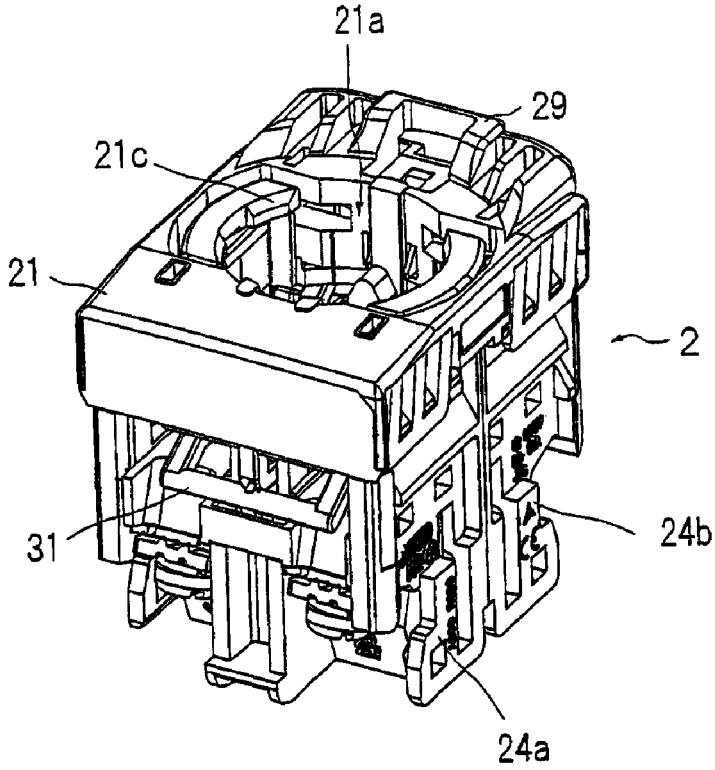

FIG. 13A1
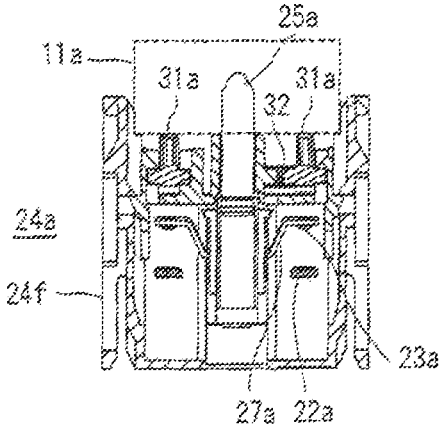
FIG. 13B1
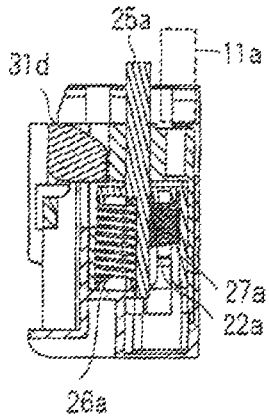
FIG. 13C1
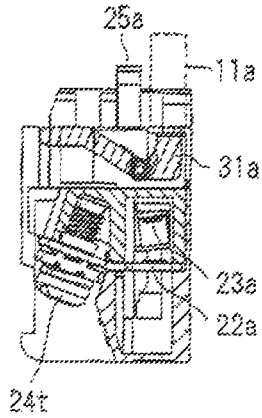
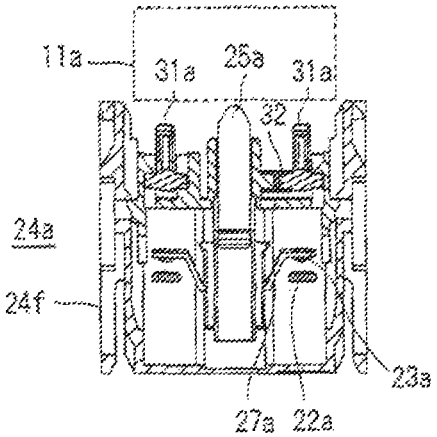
FIG. 13A2
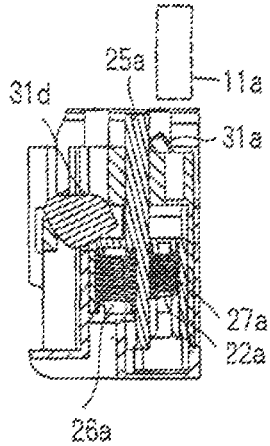
FIG. 13B2
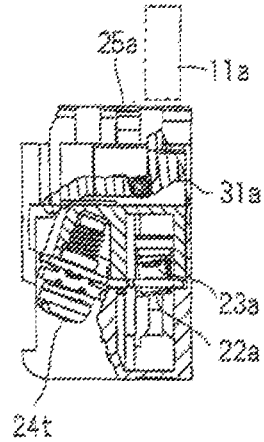
FIG. 13C2

FIG. 14A1
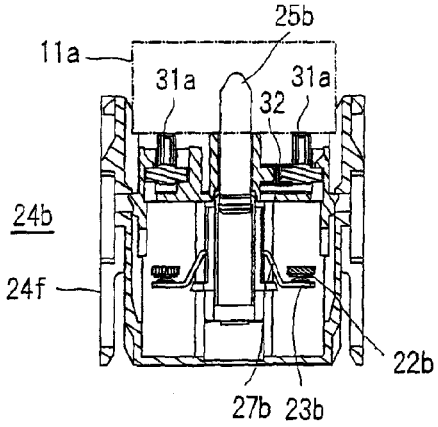
FIG. 14B1
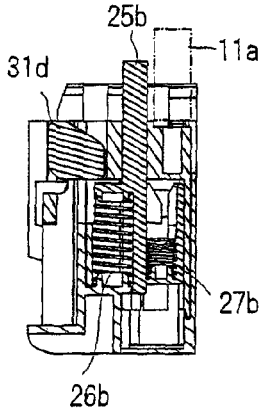
FIG. 14C1
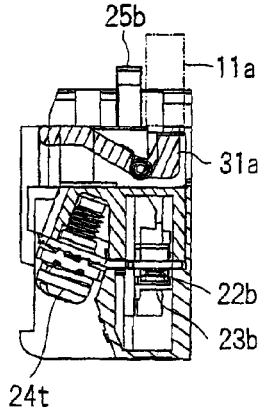
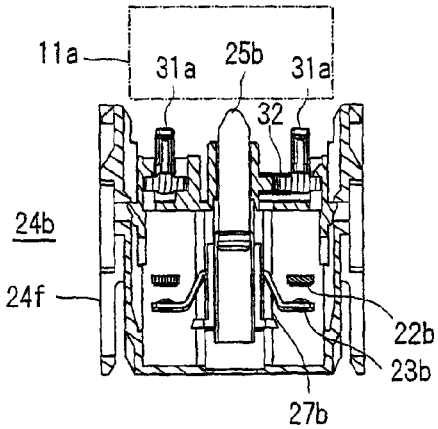
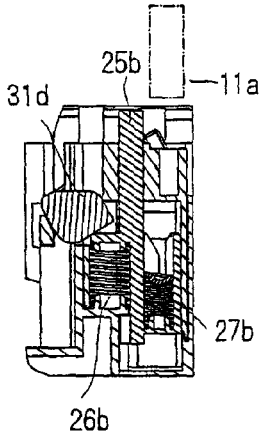
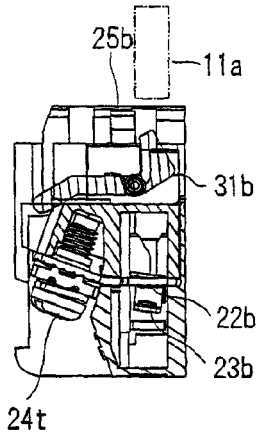
FIG. 14A2
FIG. 14B2
FIG. 14C2

FIG. 17A1
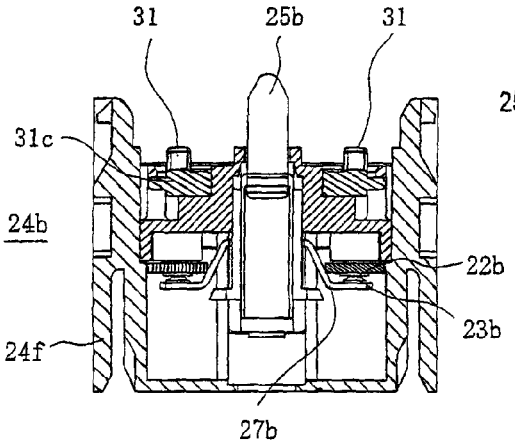
FIG. 17B1
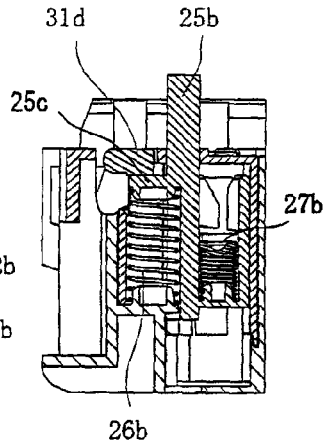
FIG. 17C1
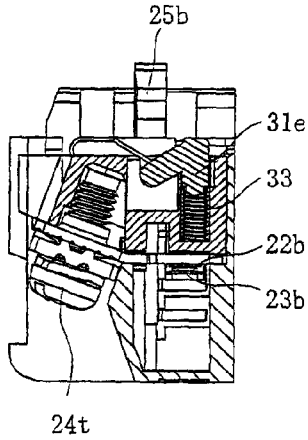
FIG. 17A2
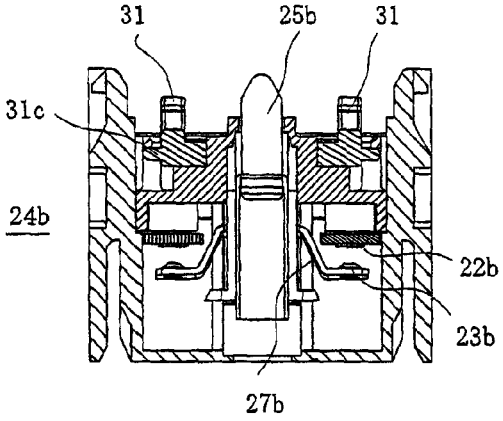
FIG. 17B2
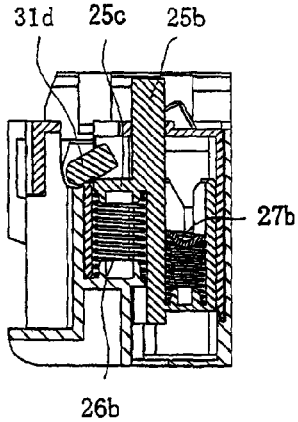
FIG. 17C2
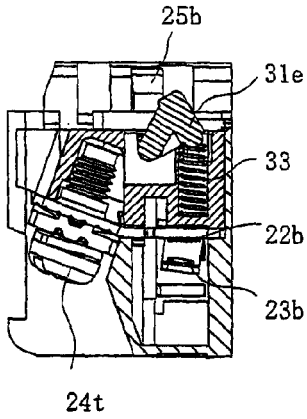

(a)

(b)

(c)

(a)

(b)

(c)

(a)

(b)

(c)

PUSH BUTTON SWITCH

BACKGROUND OF THE INVENTION

The present invention relates to a push button switch which is attached to a control panel of a machine tool or the like, and used to give an emergency stop instruction etc. to the machine tool or similar instrument.

A push button switch for emergency stop is generally formed by combining and coupling a switch portion and an operation portion. The switch portion has a switching contact unit constituted by a fixed contact and a movable contact which is opened/closed against the fixed contact. The operation portion has a push button operation mechanism for performing an operation of opening/closing the switching contact unit.

FIGS. 28A-36 illustrate an example of a convention push button switch configuration. FIGS. 28A and 28B are perspective views showing the external appearance of the push button switch. FIGS. 29A-32B are sectional views of the push button switch shown in FIGS. 28A and 28B, taken on different cutting lines respectively.

In the drawings, the reference numeral 1 represents an operation portion in which an operation mechanism is received in an operation portion case 11. The operation mechanism includes a push button 12, a push rod 13, etc. The push button 12 can be operated to be pushed in. The push rod 13 is linked with the push button 12 so as to work together therewith.

The reference numeral 2 represents a switch portion which receives a switching contact unit 24*a* and a switching contact unit 24*b*. The switching contact unit 24*a* has a normally open contact ("a" contact) configuration including a fixed contact 22*a* and a movable contact 23*a* which are normally open. The switching contact unit 24*b* has a normally closed contact ("b" contact) configuration including a fixed contact 22*b* and a movable contact 23*b* which are normally closed. Each switching contact unit has a movable frame 25*a*, 25*b* which slides supporting the movable contact 22*a*, 22*b*.

The operation portion 1 and the switch portion 2 are formed separately as shown in FIG. 29. A fitting hole 21*a* is provided in a case 21 of the switch portion. A body portion 11*a* at a leading end of a cylindrical case 11 of the operation portion 1 is fitted into the fitting hole 21*a*. A hook 21*c* provided in the inner circumference of the fitting hole 21*a* of the switch portion case 21 is engaged with an engagement recess 11*c* provided in the outer circumference of the body portion 11*a* so that the operation portion 1 and the switch portion 2 are coupled and combined integrally. To release the operation portion 1 and the switch portion 2 from the coupling, a slider 29 provided in the switch portion 2 is operated to release the hook 21*c* from the engagement with the engagement recess 11*c*.

FIGS. 29A to 32B show sectional views taken on cutting lines XIX and XXII in FIG. 28B respectively. Each FIG. 29A-32A shows a standby state in which the push button 12 of the push button switch has not been pushed in but is put in its initial reset position. Each FIG. 29B-32B shows an operating state in which the push button 12 has been pushed into an operating position in the lower side of the drawing.

The operation portion 1 is provided with a lock mechanism to keep the push button 12 pushed in. The lock mechanism is constituted by a protrusion 13*c* and a lock plate 11*c*. The protrusion 13*c* is provided in the outer circumference of the push rod 13. The lock plate 11*c* is provided in the inner circumference of the body portion 11*a* of the case 11. When the push button 12 is pushed in at the standby position where the push button 12 has not been pushed in, the push rod 13 linked with the push button 12 moves down in connection therewith. When the protrusion 13*c* of the push rod 13 gets over the lock plate 11*c* and reaches a push-in position, the protrusion 13*c* engages with the lower end of the lock plate 11*c* so as to prevent the push button 12 from returning. Thus, the push button 12 is kept in the push-in position even after it is released from operation. To return the push button 12 to the standby position from the push-in position, the push button 12 is rotated at a predetermined angle to release the lock plate 11*c* and the protrusion 13*c* of the push rod 13 from engagement so as to release the push button 12 from the lock. Due to a return spring 14 consisting of a torsion coil spring, the rotated push button 12 is returned to the reset position where the push button 12 had been put before the rotation.

In the state where the operation portion 1 and the switch portion 2 have been coupled, as shown in FIG. 29A, the movable frames 25*a* and 25*b* respectively supporting the movable contacts of the switching contact units of the switch portion 2 are pushed up by return springs 26*a* and 26*b* respectively. Thus, the upper end of each movable frame 25*a*, 25*b* is brought into contact with the lower end of the push rod 13 linked with the push button 12 of the operation portion 1. When the push button 12 is in the standby position, the movable contact 23*a* leaves the fixed contact 22*a* as shown in FIG. 31A. Thus, the switching contact unit 24*a* having the normally open contact ("a" contact) configuration is turned off. On the other hand, the movable contact 23*b* contacts with the fixed contact 22*b* as shown in FIG. 32A. Thus, the switching contact unit 24*b* having the normally closed contact ("b" contact) configuration is turned on.

Here, when the push button 12 is operated to be pushed down against the return spring 14, the movable frames 25*a* and 25*b* of the switch portion 2 are pushed down by the push rod 13 working with the push button 12, so that the movable contacts 23*a* and 23*b* move down together with the movable frames 25*a* and 25*b*. As a result, the movable contact 23*a* contacts with the fixed contact 22*a* as shown in FIG. 31B. Thus, the switching contact unit 24*a* having the normally open contact configuration is turned on. On the other hand, the movable contact 23*b* leaves the fixed contact 22*b* as shown in FIG. 32B. Thus, the switching contact unit 24*b* having the normally closed contact configuration is turned off.

The push button switch configured thus is in use attached to a panel such as a control panel. The process of attaching the push button switch will be described below. First, as shown in FIG. 33, a fixing nut 19 is detached from the operation portion 1 from which the switch portion 2 has been removed, and the body portion 11*a* is inserted into a mounting hole of the panel on the front side of the panel. Next, on the back side of the panel, the fixing nut 19 is screwed down to the inserted body portion 11*a* of the operation portion 1 so that the body portion 11*a* is fastened and fixed to the panel. The fitting hole 21*a* of the switch portion 2 is fitted to the body portion 11*a* of the operation portion 1 attached to the panel. Thus, the switch portion 2 is coupled and connected to the operation portion 1.

In the push button switch attached to a control panel or the like in use in this manner, there may occur an accident in which the switch portion 2 drops off the operation portion 1 for some reason when the push button switch is in use. When there occurs such an accident in which the switch portion 2 drops off the operation portion 1 in the state where the push button switch is operated to be pushed in, the mode in which the switch portion 2 is pushed in by the push rod 13 of the operation portion 1 is canceled so that the movable frames 25*a* and 25*b* of the switch portion 2 are returned to their reset positions by the return springs 26*a* and 26*b*. As shown in FIGS. 36 and 37, the normally open contact unit 24*a* is turned off again, while the normally closed contact unit 24*b* is turned on again.

Assume that the normally closed contact unit 24*b* is used for issuing an emergency stop instruction. When the normally closed contact unit is returned to be turned on due to an accident in which the switch portion 2 drops off the operation portion 1 in this case, the emergency stop instruction is cancelled so that there is a risk that a significant accident may be caused by resumed operation of an instrument which has been emergency-stopped.

In order to avoid such a risk, the opened movable contact of the switching contact unit having the normally closed contact configuration, which unit is used particularly as a switching contact unit for issuing an emergency stop instruction, has to be prevented from returning to the position where the movable contact will contact with the fixed contact, when the switch portion 2 of the push button switch drops off the operation portion.

As push button switches for solving such a problem, push button switches have been known in the background art as disclosed in Japanese Unexamined Patent Publication No. (Kokai) JP-A-2001-035302, Japanese Unexamined Patent Publication No. (Kokai) JP-A-2003-303527, Japanese Unexamined Patent Publication No. (Kokai) JP-A-2007-115703.

FIGS. 38-40 show the configuration of the conventional push button switch disclosed in JP-A-2001-035302. The conventional push button switch has an operation portion 1 and a switch portion 2. The operation portion 1 includes a push button 12, an operation portion case 11 and a push rod 13. The operation portion case 11 supports the push button 12 slidably thereon. The push rod 13 is provided in the operation portion case 11 so as to work with the motion of the push button 12. The switch portion 2 is removably attached to the lower portion of the operation portion case 11 of the operation portion 1.

The switch portion 2 has a fixed contact maker 22*c* and a fixed contact 22*b*. The fixed contact maker 22*c* has a folded portion with vertical flexibility. The fixed contact maker 22*c* is displaceably fixed to a switch portion case 21. The fixed contact 22*b* is disposed on the tip of the folded portion of the fixed contact maker 22*c*. The switch portion 2 also has a movable contact maker 23*c* and a movable contact 23*b*. The movable contact maker 23*c* is supported by a movable frame 25*b*. The movable frame 25*b* is urged toward the fixed contact 22*b* by a first spring 27 and urged away from the fixed contact by a second spring 28. The movable contact 23*b* is disposed on the tip of the movable contact maker 23*c*.

When the operation portion 1 and the switch portion 2 configured thus are coupled with each other, the fixed contact 22*b* and the movable contact 23*b* of the switch portion 2 contact with each other to form an initial ON state (see FIG. 38).

When the push button 12 is pushed in during the initial ON state, a pressing force from the push rod 13 held in the push-in position by a lock mechanism 18 is applied to the folded portion of the fixed contact maker 22*c* through a second movable frame 25*c*. Thus, the fixed contact 22*b* is put away from the movable contact 23*b* to be brought into an OFF state (see FIG. 39).

When the switch portion 2 is released from the coupling and separated from the operation portion 1, the movable frame 25*b* supporting the movable contact 23*b* and the second movable frame 25*c* are pushed up by the effect of the elastic repulsion of the second spring 28. Thus, the movable contact 23*b* can be put away from the fixed contact 22*b* to form an OFF state (see FIG. 40).

The conventional push button switch disclosed in JP 2003-303527 is configured as shown in FIGS. 41 and 42, wherein an operation portion 1 has a push button 12, a push rod 13, a return spring 14, a lock mechanism 18, etc. The push button 12 is slidably supported by an operation portion case 11. The push rod 13 is linked with the push button 12. The return spring 14 serves to return the push button 12. The lock mechanism 18 serves to hold the push button 12 in a push-in position. A switch portion 2 receives a switching contact mechanism in a switch portion case 21 removably coupled with the lower end portion of the operation portion case 11 of the operation portion 1. The switching contact mechanism has a normally closed contact configuration constituted by a fixed contact 22*b* and a movable contact 23*b*. A movable contact maker 23*c* to which the movable contact 23*b* is attached is supported by a movable frame 25*b*. A spring 28 for urging the movable contact 23*b* away from the fixed contact 22*b* is provided between the movable frame 25*b* and the switch portion case 21.

When the switch portion 2 is coupled with the operation portion 1, the movable frame 25*b* is linked with the push rod 13 working with the push button 12 of the operation portion 1. The spring force of the spring 28 urging the movable contact 23*b* of the switch portion 2 away from the fixed contact 22*b* is made smaller than the spring force of the return spring 14 pushing up the push button of the operation portion 1. Thus, the spring forces of the respective springs are balanced to prevent the movable contact 23*b* from leaving the fixed contact 22*b* before the push button 12 is operated to be pushed in.

In the state where the push button is in the reset (initial) position where the push button has not been pushed in yet, the movable frame 25*b* of the switch portion 2 is lifted up by the push rod 13 of the operation portion 1 against the spring force of the opening spring 28 so that the movable contact 23*b* contacts with the fixed contact 22*b* to form an ON state, as shown in FIG. 41. As soon as the push button 12 is operated and pushed in as shown in FIG. 42, the push rod 13 is held in the push-in position by the lock mechanism 18. The movable frame 25*b* is pushed down as the push rod 13 is pushed in. Thus, the movable contact 23*b* leaves the fixed contact 22*b* to form an OFF state.

Once the operation portion 1 and the switch portion 2 are released from coupling with each other so that the switch portion 2 is separated from the operation portion 1, the movable frame 25*b* becomes free. Thus, the movable frame 25*b* is pushed down to put the movable contact 23*b* away from the fixed contact 22*b* by the spring force of the opening spring 28 so as to bring the switch portion 2 into an OFF state.

According to conventional push button switches disclosed in JP-A-2001-035302 or JP-A-2003-303527, an operation portion and a switch portion are removably coupled with each other. Once an accident occurs in which the switch portion drops off the operation portion in the push button switch, one of two closed contacts of a switching contact unit having a normally closed contact configuration is driven to be open to the other contact by an opening spring. Thus, the two contacts can be opened surely to form an OFF state.

However, according to the mechanism which opens the switching contacts of the switching contact unit having the normally closed contact configuration to form an OFF state as soon as the switch portion drops off the operation portion in the conventional push button switch, it is necessary to make both the contacts movable or to balance the spring force of the opening spring with the spring force of the return spring of the operation portion. Thus, there is a problem that the push button switch is too complicated in configuration to manufacture.

SUMMARY OF THE INVENTION

The invention provides a push button switch which is simple in configuration and easy to manufacture; which has an operation portion and a switch portion removably coupled with each other; and in which as soon as the switch portion drops off the operation portion, switching contacts of a switching contact unit having a normally closed contact configuration are surely opened to form an OFF state.

In order to solve the foregoing problem, the invention provides a push button switch including an operation portion and a switch portion which are removably coupled with each other, the operation portion having a push button to be subjected to a push-in operation, the switch portion having a switching contact unit whose contacts are opened/closed in connection with the push-in operation of the push button of the operation portion, wherein the switch portion includes a contact opening mechanism constituted by a lever which is rotatably supported and which has one end acting on a part of the operation portion coupled with the switch portion and the other end acting on a contact switching mechanism of the switching contact unit in the switch portion so as to operate to open/close contacts, and a spring which urges the lever in a fixed rotation direction, and the contact switching mechanism of the switching contact unit is urged to move a movable contact from a standby state position toward an operating state position by the contact opening mechanism as soon as the switch portion is separated from the operation portion, while the contact switching mechanism of the contact unit is released from the urging as soon as the switch portion is coupled with the operation portion.

In the invention, the lever in the contact opening mechanism may have a rotary fulcrum in an intermediate portion thereof. An urging force in one end of the lever acts on the operation portion while an urging force in the other end of the lever acts on a contact portion. When the switch portion is coupled with the operation portion, the urging force of the lever is borne by the operation portion so that the urging force can be prevented from acting on the switch portion.

In addition, a torsion coil spring or a compression coil spring may be used as the spring which urges the lever of the contact opening mechanism in the fixed rotation direction.

In addition, in the invention, it is preferable that, when the operation portion and the switch portion has been coupled with each other, a push rod working with the push button in the operation portion and a movable frame supporting the movable contact forming the switching mechanism of the contact unit in the switch portion are brought into contact with each other in their opposed end portions so as to transfer an operating force therebetween.

Further, in the invention, when the switch portion leaves the operation portion in the case where the switching contact unit has normally open contacts, a displacement of the normally open contacts caused by the switching mechanism of the contact unit urged to close the normally open contacts by the contact opening mechanism is limited not to allow the movable contact to contact with the fixed contact.

In the invention, one or plural switching contact units may be provided in the switch portion, and the contact opening mechanism may be provided for each switching contact unit.

In addition, the switching contact unit provided in the switch portion may have plural sets of switching contacts and a common movable frame collectively holding movable contacts of the respective sets of switching contacts, and the contact opening mechanism may be provided in connection to the switching contact unit.

Furthermore, the push button switch according to the invention may be received in a box which is divided into a base and a cover. The push button switch can be configured as a box-mounted push button switch. In this case, the operation portion and the switch portion may be coupled by fixing the switch portion to the base, attaching the operation portion to the cover, and placing the cover on the base for integration.

In addition, when the switch portion in the push button switch according to the invention is received in the box, the switch portion is fitted into the base to be temporarily retained in a predetermined reception position and the base is covered with the cover to be coupled integrally so that the switch portion is held and fixed by the cover and the base from above and below. Specifically, the push button switch according to the invention can be configured in the following modes:

(1) Relay terminal fittings with terminal screws are provided. One end of each relay terminal fitting is connected to a corresponding leading-out terminal provided in a switching contact unit of the switch portion while the other end thereof is led out to an upper surface side of the base of the box. The base is covered with the cover of the box to be coupled integrally. In this state, the relay terminal fittings are put between terminal bases formed in the base and press ribs formed on an inner side of the cover, so that the switch portion is held and fixed;

(2) The terminal fittings are pressed into grooves of the terminal bases formed in the base of the box so as to temporarily fix the switch portion to the base;

(3) A switch portion attachment frame is provided in a bottom portion of the base of the box and the switch portion is fitted into the attachment frame to be snap-fit connected thereto.

According to the invention, in a push button switch in which an operation portion and a switch portion are removably coupled, a contact unit has normally closed contacts, and the normally closed contacts are automatically opened as soon as there occurs an accident in which the switch portion drops off the operation portion. It is therefore possible to prevent a danger that emergency stop operation may be canceled due to the accident in which the switch portion drops off the operation portion. Thus, the safety of the push button switch can be enhanced.

A contact opening mechanism used in the invention is designed independently of an operation mechanism of the operation portion. It is therefore possible to design and manufacture a spring system of the contact opening mechanism independently of a spring system of the operation portion. Thus, the push button switch can be designed and manufactured easily.

When the push button switch is in use received in a box divided into a base and a cover, the cover and the base of the box may be fastened so insufficiently as to cause an accident in which the cover may drop off the base. Even in such a case, the accident can be detected, and the normally closed contacts can be opened to make the push button switch safe.

Further, assume that a box-mounted push button switch to be connected to external wires is constructed by incorporating the push button switch into an operation box (optional component) which is divided into a base and a base. In this case, in accordance with the assembling structure of the invention, the operation portion having the aforementioned structure and mounted on a control panel etc. in use and the switch portion can be used as common components. Only if simple leading-out terminals are added to the switching contact unit of the switch portion, the switch portion can be fixed and supported in a predetermined position in the box without requiring a labor-consumed operation of screwing and fixing the switch portion to the base of the box, while an operation for connecting the push button switch to the external wires can be performed easily. Thus, serviceability to users and maintainability can be improved.

Other features, advantages, modifications, etc. of the invention will become apparent to those skilled in the art from the following detailed description of the preferred embodiments.

BRIEF DESCRIPTION OF THE DRAWINGS

The invention will be described with reference to certain preferred embodiments thereof and the accompanying drawings, wherein:

FIG. 6 is a perspective view showing a state where an operation portion and a switch portion of the push button switch according to the first embodiment of the invention have been separated;

FIGS. 13A1-13A2 to 13C1-13C2 are sectional views taken on cutting lines a-a to c-c in FIG. 11 respectively and showing an operating state of a switching contact unit with a normally open contact ("a" contact) configuration including the contact opening mechanism for use in the invention;

FIGS. 14A1-14A2 to 14C1-14C2 are sectional views taken on cutting lines a-a to c-c in FIG. 11 respectively and showing an operating state of a switching contact unit with a normally closed contact ("b" contact) configuration including the contact opening mechanism for use in the invention;

FIGS. 17A1-17A2 to 17C1-17C2 are sectional views taken on cutting lines a-a to c-c in FIG. 15 respectively and showing an operating state of a switching contact unit with a normally closed contact ("b" contact) configuration including the contact opening mechanism for use in the second embodiment of the invention;

DETAILED DESCRIPTION OF THE PREFERRED EMBODIMENTS

FIGS. 1A-1B to 5A-5B, FIGS. 6 to 12, FIGS. 13A1-13A2 to 13C1-13C2 and FIGS. 14A1-14A2 to 14C1-14C2 show a first embodiment of the invention.

Figure 1A:
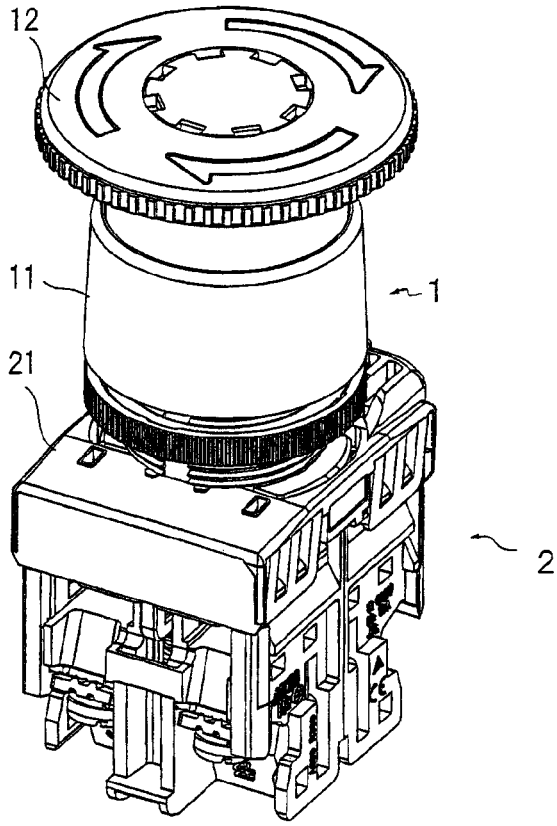
FIG. 1A is a perspective view showing the external appearance of a push button switch according to a first embodiment of the invention.
Figure 1B:
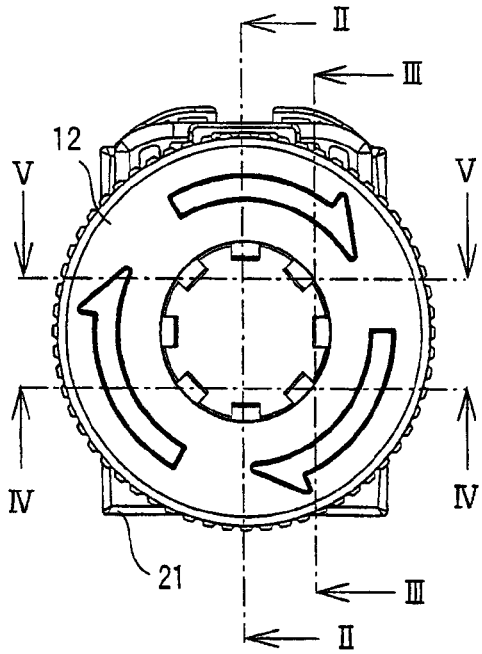
FIG. 1B is a plan view of the same.
Figure 2A:
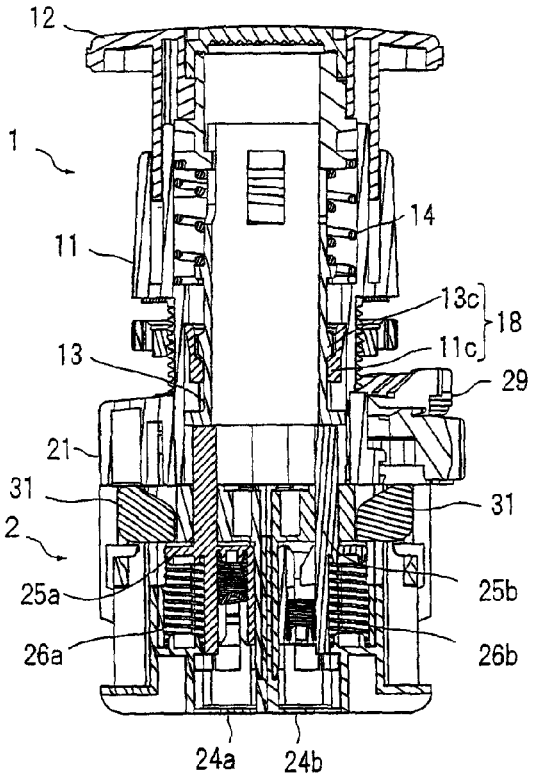
FIG. 2A is a sectional view taken on cutting line II-II in FIG. 1B and showing a standby state of the push button switch according to the first embodiment of the invention.
Figure 2B:
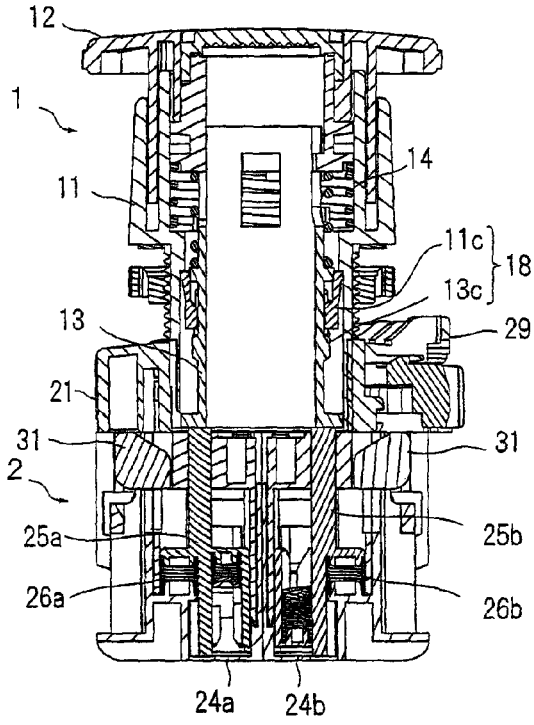
FIG. 2B is a sectional view likewise showing an operating state of the same.
Figure 3A:
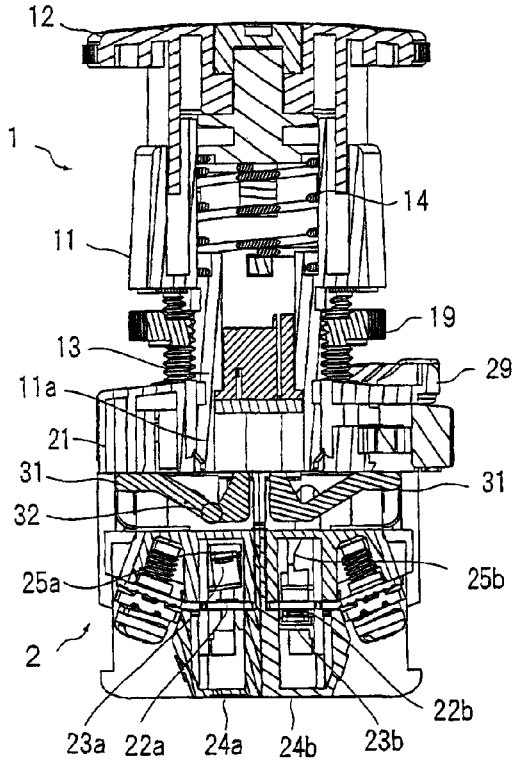
FIG. 3A is a sectional view taken on cutting line III-III in FIG. 1B and showing the standby state of the push button switch according to the first embodiment of the invention.
Figure 3B:
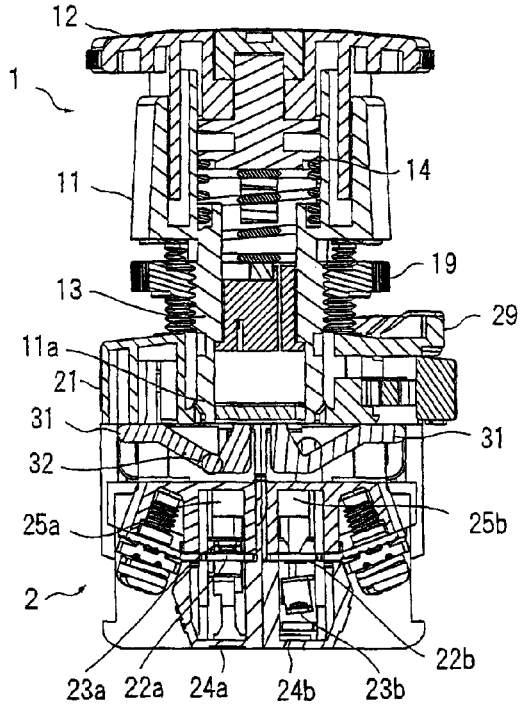
FIG. 3B is a sectional view likewise showing the operating state of the same.

FIGS. 1A and 1B are a perspective view and a plan view showing the external appearance of a push button switch according to the first embodiment of the invention. FIGS. 2A-2B to 5A-5B are sectional views taken on lines II-II to V-V in FIG. 1B respectively and showing working states of the invention. Each FIG. 2A-5A shows a standby state where a push button has not been pushed in yet, while each FIG. 2B-5B shows an operating state where the push button has been pushed into a push-in position.

FIG. 6 is a perspective view showing a state where an operation portion and a switch portion of the push button switch according to the invention have been separated. FIGS. 7-10 are sectional views of the push button switch shown in FIG. 6, cut on the same lines as the cutting lines shown in FIG. 1B.

Figure 11:
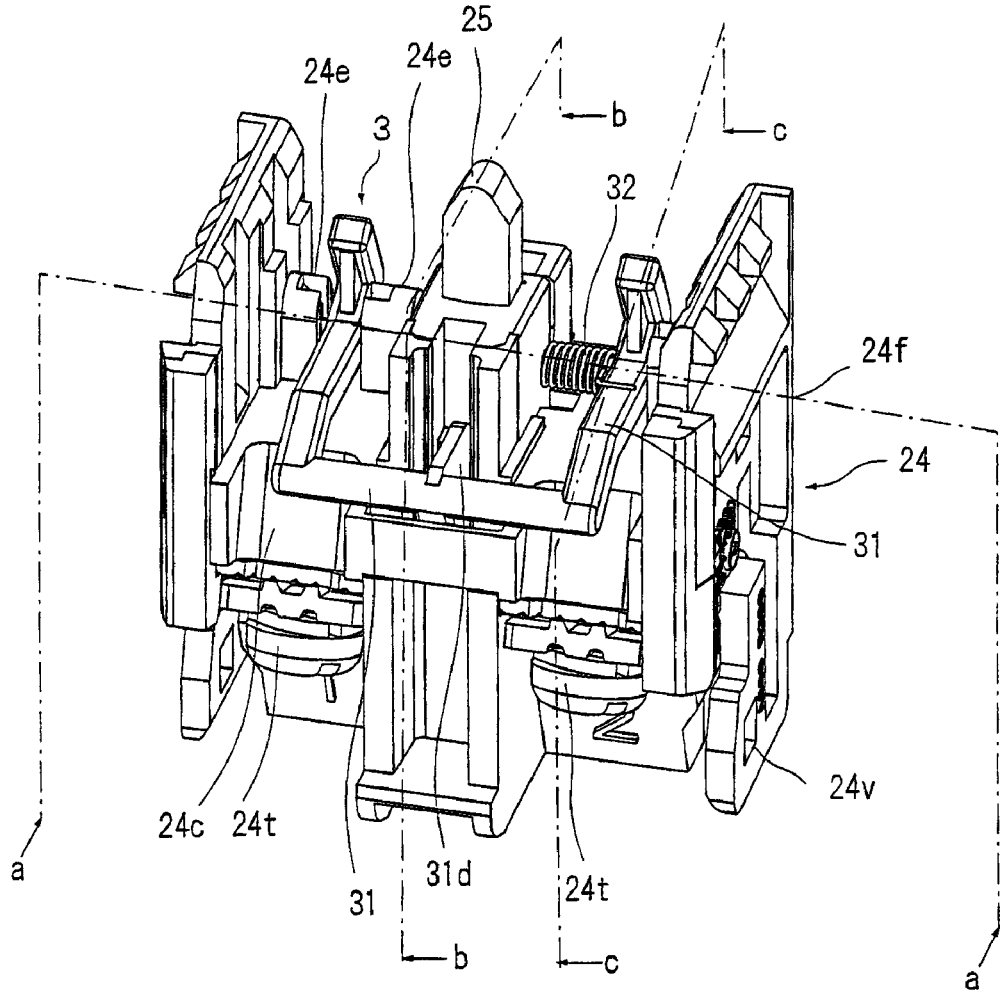
FIG. 11 is a perspective view showing the external appearance of a switching contact unit having a contact opening mechanism for use in the invention.
Figure 12:
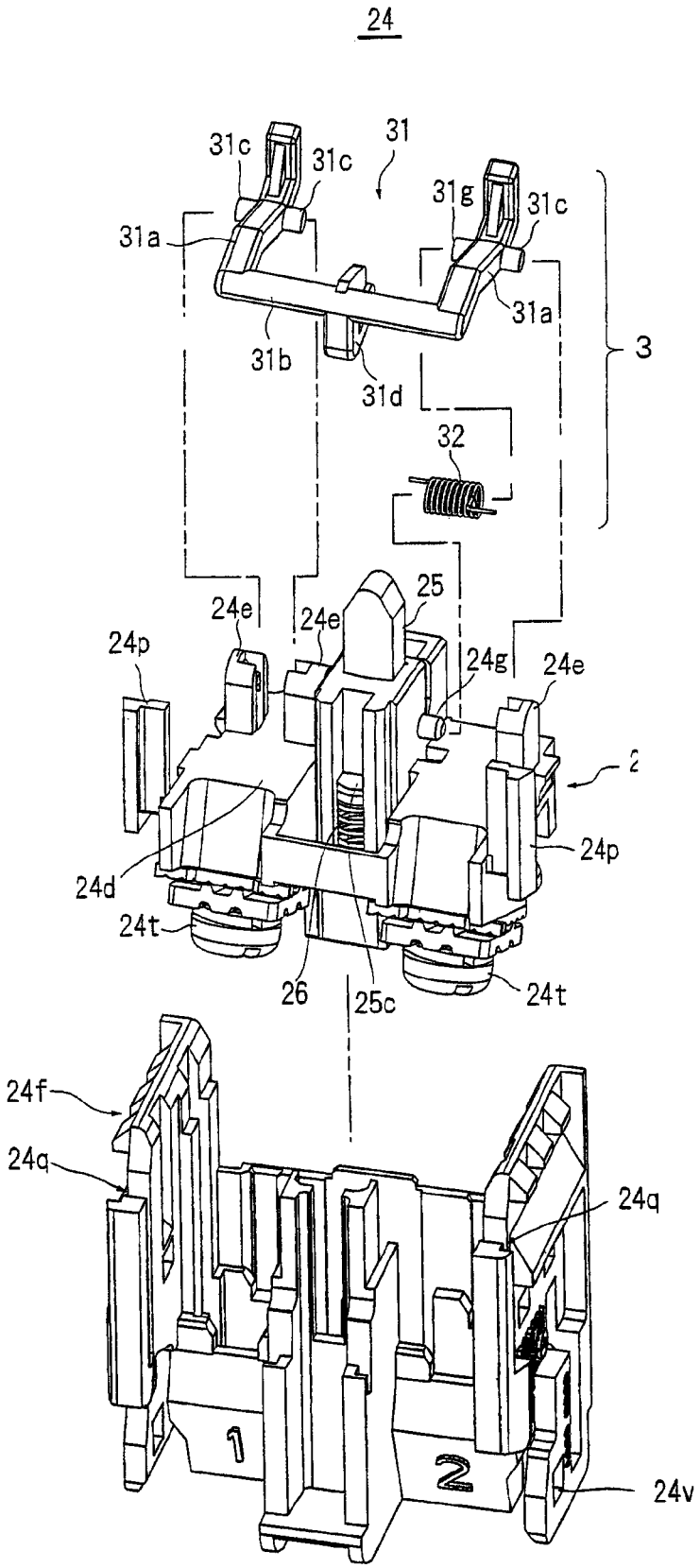
FIG. 12 is an exploded perspective view showing the switching contact unit having the contact opening mechanism for use in the invention.

FIGS. 11 and 12, FIGS. 13A1-13A2 to 13C1-13C2 and FIGS. 14A1-14A2 to 14C1-14C2 show a configuration example of a switching contact unit of the switch portion for use in the invention. FIG. 11 is a perspective view showing the configuration of the external appearance of the contact unit. FIG. 12 is an exploded perspective view showing the configuration of the contact unit. FIGS. 13A1-13A2 to 13C1-13C2 are sectional views taken on lines a-a to c-c in FIG. 11 respectively and showing a working state of a switching contact unit with a normally open contact configuration. FIGS. 14A1-14A2 to 14C1-14C2 are sectional views taken on lines a-a to c-c in FIG. 11 respectively and showing a working state of a switching contact unit with a normally closed contact configuration.

The principal configuration of the push button switch according to the embodiment of the invention shown in these drawings is the same as the configuration of the conventional push button switch shown in FIGS. 24A-24B to 28A-28B and FIGS. 29 to 33. Constituent parts the same as those in the conventional are referred to by the same numerals correspondingly, and will be described briefly. Different constituent parts from those in the background art will be described in detail.

In the same manner as the conventional push button switch, the push button switch according to the invention is used in the state where an operation portion 1 and a switch portion 2 formed separately as shown in FIG. 6 have been coupled and connected as shown in FIGS. 1A and 1B. The operation portion 1 has a push button 12 which is vertically movably inserted into and supported on an operation portion case 11. The switch portion 2 is designed so that a switching contact unit 24*a* having a normally open contact ("a" contact) configuration and a switching contact unit 24*b* having a normally closed contact ("b" contact) configuration are received in a switch portion case 21.

Figure 4A:
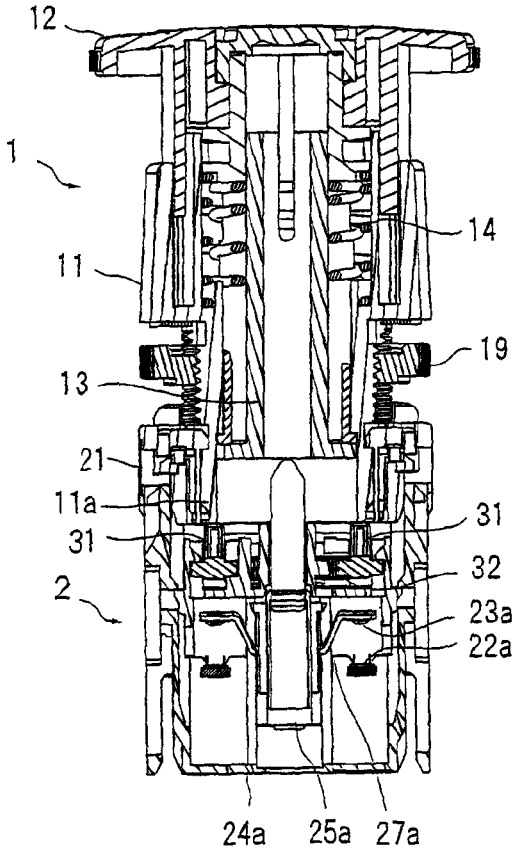
FIG. 4A is a sectional view taken on cutting line IV-IV in FIG. 1B and showing the standby state of the push button switch according to the first embodiment of the invention.
Figure 4B:
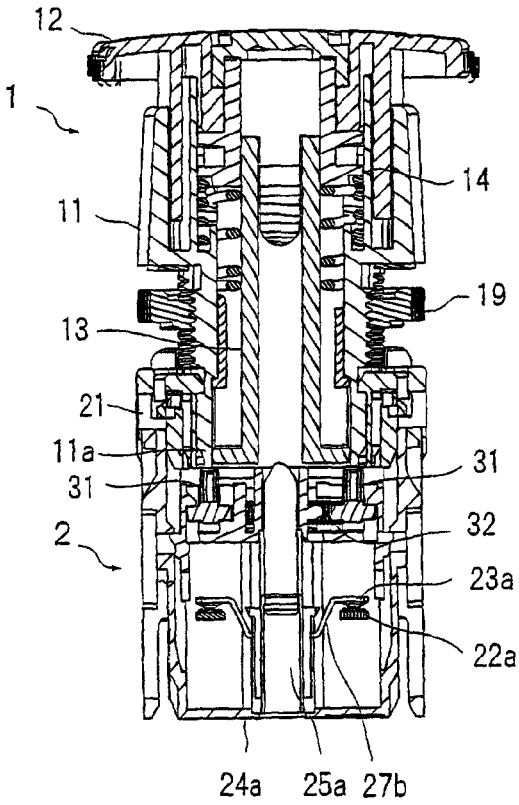
FIG. 4B is a sectional view likewise showing the operating state of the same.
Figure 5A:
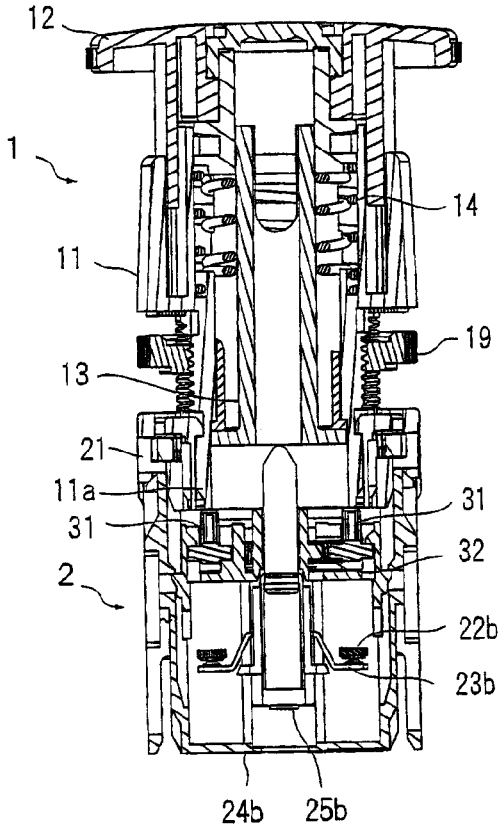
FIG. 5A is a sectional view taken on cutting line V-V in FIG. 1B and showing the standby state of the push button switch according to the first embodiment of the invention.

FIGS. 2A-5A show the standby state in which the push button 12 of the push button switch configured thus is in a standby position where the push button 12 has not been pushed in yet. In this state, movable frames 25*a* and 25*b* supporting movable contact makers 27*a* and 27*b* to which movable contacts 23*a* and 23*b* of the switching contact units 24*a* and 24*b* of the switch portion 2 have been fixedly attached are pushed up by return springs 26*a* and 26*b* respectively so that the leading ends of the movable frames 25*a* and 25*b* are linked with the push button 12 of the operation portion 1 and brought into contact with the lower end of the push rod 13 working with the push button 12. In this state, as shown in FIG. 4A, the switching contact unit 24*a* with the normally open contact ("a" contact) configuration has been turned off because the movable contact 23*a* has left the fixed contact 22*a*. On the other hand, as shown in FIG. 5A, the switching contact unit 24*b* with the normally closed contact ("b" contact) configuration has been turned on because the movable contact 23*b* has contacted with the fixed contact 22*b*.

When the push button 12 is pushed into the push-in position here, the push rod 13 moves down in conjunction therewith and is held in the push-in position by a lock mechanism 18. When the push rod 13 moves down, the movable frames 25*a* and 25*b* of the switching contact units 24*a* and 24*b* of the switch portion 2 are pushed down. Thus, the movable contact 23*a* contacts with the fixed contact 22*a* to turn on the switching contact unit 24*a*, while the movable contact 23*b* leaves the fixed contact 22*b* to turn off the switching contact unit 24*b*.

When the push button 12 is rotated at a predetermined angle in the state where the push button 12 has been pushed in, the push rod 13 is released from being locked by the lock mechanism 18. Then, the push button 12 and the push rod 13 are pushed up by a return spring 14 consisting of a torsion coil spring, while the both are returned to the positions where they had been before they were rotated. Thus, the push button 12 and the push rod 13 are returned to their initial reset positions to stand by there. As a result, the open/close conditions of the contacts in the switching contact units 24*a* and 24*b* of the switch portion 2 are resumed to their initial conditions.

Such an operation for opening/closing the contacts in the switching contact units 24*a* and 24*b* of the switch portion 2 by the push-in operation and the return operation of the push button 12 of the operation portion 1 is the same as that in the aforementioned conventional push button switch.

As apparent from FIGS. 2A-2B to FIG. 5A-5B showing the sectional views of the push button switch, in the push button switch according to the invention, a contact opening mechanism 3 (shown in FIG. 11) constituted by a lever 31 and an opening spring 32, which is not shown here, is provided in each switching contact unit 24*a*, 24*b* of the switch portion 2. The lever 31 and the opening spring 32 are formed rotatably, and the opening spring 32 urges the lever 31 in a predetermined direction. The contact opening mechanism 3 is a mechanism which is absent from the conventional push button switch.

The detailed configuration of a switching contact unit 24 provided with the contact opening mechanism 3 will be described with reference to FIGS. 11 and 12, FIGS. 13A1-13A2 to 13C1-13C2 and FIGS. 14A1-14A2 to 14C1-14C2. The switching contact unit 24 can have one of a normally open contact ("a" contact) configuration and a normally closed contact ("b" contact) configuration if a switching contact mechanism to be received therein is selected.

The switching contact unit 24 is constituted by a unit frame 24*f*, a switching contact mechanism 24*c* and the contact opening mechanism 3 as shown in FIG. 12. The unit frame 24*f* supports the unit as a whole. The switching contact mechanism 24*c* and the contact opening mechanism 3 are received in the unit frame 24*f*.

The above-mentioned switching contact mechanism 24*c* has a movable frame 25 which is vertically movably supported on a case 24*d*. The case 24*d* is provided with a leading-out terminal 24*t* which is led out from a fixed contact 22 (see FIGS. 4A and 4B and FIGS. 5A and 5B) received in the switching contact mechanism 24*c*. A spring bearing piece 25*c* is provided to protrude from a side surface of the movable frame 25. The spring bearing piece 25*c* bears a return spring force applied upward by the upper end of a return spring 26. The lower end of the return spring 26 is supported by the case 24*d*. Thus, the movable frame 25 is urged upward by the return spring 26. The movable frame 25 supports a movable contact maker piece 27*a* or 27*b* including a movable contact 23*a* or 23*b*, which is not shown here. In the case 24*d*, a fixed contact 22*a* or 22*b* is disposed oppositely to the movable contact 23*a* or 23*b*. The two contacts form a switching contact pair. The switching contact pair can be formed as a contact pair with a normally open contact ("a" contact) configuration as shown in FIG. 13A1 or a normally closed contact ("b" contact) configuration as shown in FIG. 14A1 if the kind of movable contact is selected.

The lever 31 of the contact opening mechanism 3 is formed into a U-shape by a pair of parallel rotary arms 31*a* and 31*a* and a connector arm 31*b* connecting the tips of the rotary arms 31*a* and 31*a* with each other. A rotary shaft 31*c* is formed in an intermediate portion of each rotary arm 31*a*. A pressure piece 31*d* is provided in an intermediate portion of the connector arm 31*b* so as to protrude downward. The rotary shafts 31*c* protruding outward are inserted into grooves of bearing pieces 24*e* formed to protrude from the upper surface of the case 24*d* of the switching contact mechanism 24*c*, respectively. Thus, the lever 31 configured thus is supported rotatably by the case 24*d*. Another rotary shaft 31*g* on the inner side of one of the rotary arms and a support shaft 24*g* provided in the switching contact mechanism 24*c* are connected to each other through an opening spring 32 consisting of a torsion coil spring (torsion spring). The pressure piece 31*d* of the lever 31 is inserted into a groove 24*h* of the case 24*d* of the switching contact mechanism 24*c*. The spring bearing piece 25*c* of the movable frame 25 is guided by the groove 24*h*. Therefore, the pressure piece 31*d* can detachably contact with the spring bearing piece 25*c* in accordance with the rotation of the lever 31.

In this manner, the contact opening mechanism 3 is built in the switching contact mechanism 24*c*. Fitting protrusions 24*p* of the switching contact mechanism 24*c* are fitted into fitting grooves 24*q* of the unit frame 24*f* so that the switching contact mechanism 24*c* is mounted on the frame 24*f*. Thus, the switching contact unit 24 as shown in FIG. 11 is formed.

The switching contact unit 24 configured thus is built in the switch portion case 21 as the switching contact unit 24*a* with a normally open contact configuration or the switching contact unit 24*b* with a normally closed contact configuration. Thus, the switch portion 2 is arranged. When the switch portion 2 and the operation portion 1 are coupled and connected, the push button switch is completed.

The opening spring 32 of the contact opening mechanism 3 built in the switching contact unit 24 has one end fixed to the case 24*d* of the switching contact mechanism and the other end fixed to the rotary arm 31*a* of the lever 31. Thus, a counterclockwise urging force is always applied to the lever 31 by the opening spring 32.

However, the switching contact unit 24 is designed as follows. That is, as soon as the switch portion 2 is coupled with the operation portion 1 having the push button 12, the lower end of the body portion 11*a* at the leading end of the case 11 of the operation portion 1 inserted into the switch portion 2 is brought into abutment against the base-side (opposite to the connector arm) end portion of the lever 31 so as to push down the base-side end portion of the lever 31 slightly against the urging force of the opening spring 32 as well shown in FIGS. 3A and 3B. Thus, in the state where the switch portion 2 has been coupled with the operation portion 1, the lever 31 is rotated clockwise with its rotary shaft 31*c* as a fulcrum. As a result, the pressure piece 31*d* on the leading end side (connector arm 31*b* side) of the lever 31 moves upward to leave the spring bearing piece 25*c* of the movable frame 25 of the switching contact mechanism. Thus, the urging force applied to the movable frame 25 by the opening spring 32 is canceled.

Accordingly, in the state where the switch portion 2 has been perfectly coupled with and connected to the operation portion 1, the movable contact 23*a* leaves the fixed contact 22*a* to turn off the switching contact mechanism of the switching contact unit 24*a* with the normally open contact ("a" contact) configuration as shown in FIGS. 13A1-13C1 and FIG. 4A. On the other hand, the movable contact 23*b* contacts with the fixed contact 22*b* to turn on the switching contact mechanism of the switching contact unit 24*b* with the normally closed contact ("b" contact) configuration as shown in FIGS. 14A1-14C1 and FIG. 5A.

Figure 5B:
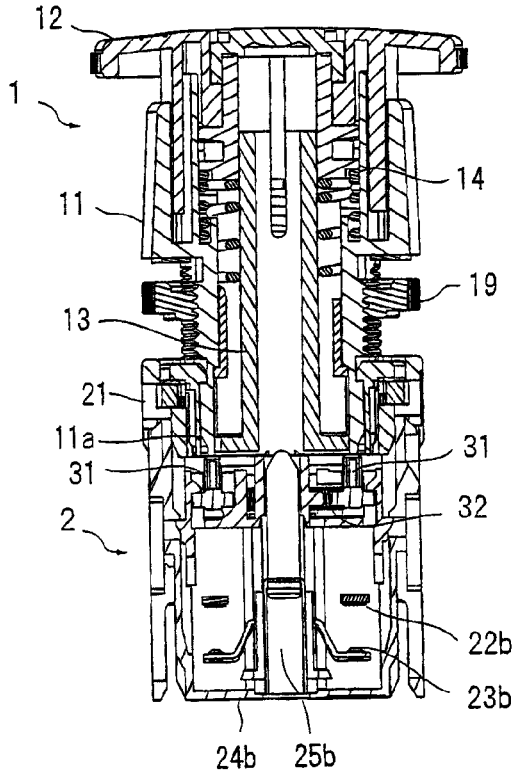
FIG. 5B is a sectional view likewise showing the operating state of the same.
Figure 7:
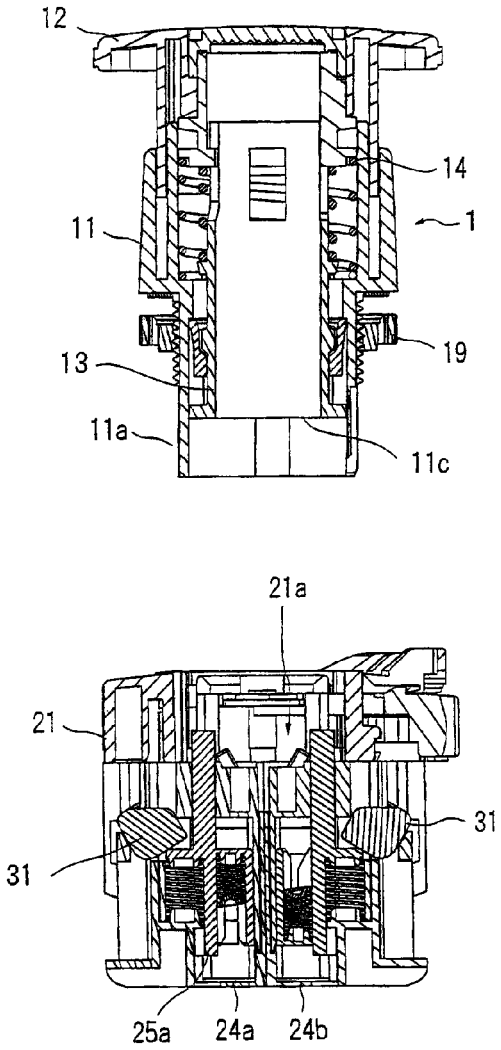
FIG. 7 is a sectional view taken on cutting line cutting II-II in FIG. 1B and showing the state where the operation portion and the switch portion of the push button switch according to the first embodiment of the invention have been separated.
Figure 8:
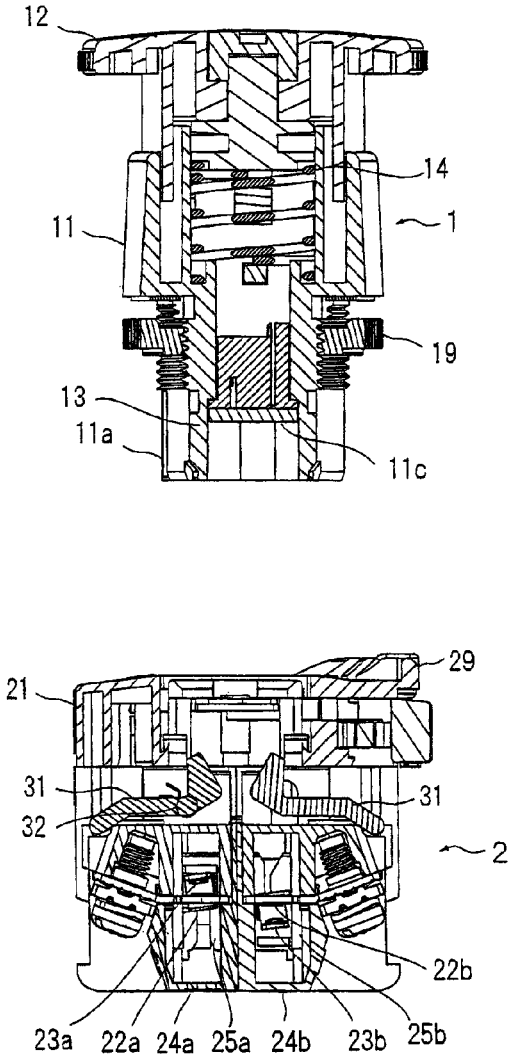
FIG. 8 is a sectional view taken on cutting line III-III in FIG. 1B and showing the state where the operation portion and the switch portion of the push button switch according to the first embodiment of the invention have been separated.

When the push button 12 is pushed in here to set an operating state, the movable frame 25*a*, 25*b* of the switching contact unit 24*a*, 24*b* is pushed down by the push rod 13 working with the push button 12. Thus, the movable contact 23*a* contacts with the fixed contact 22*a* to turn on the switching contact unit 24*a* having the normally open contact ("a" contact) configuration as shown in FIG. 4B. On the other hand, the movable contact 23*b* leaves the fixed contact 22*b* to turn off the switching contact unit 24*b* having the normally closed contact ("b" contact) configuration as shown in FIG. 5B.

In the state where the switch portion 2 has been perfectly coupled with the operation portion 1, in the lever 31 of the contact opening mechanism 3, the urging force of the opening spring 32 is borne by the base side end portion of the lever 31 joined to the body portion 11*a* of the operation portion 1. Thus, the urging force of the opening spring 32 is not transmitted to the movable frame 25 of the switching contact mechanism through the pressure piece 31*d* on the leading end side of the lever 31. Thus, the switching operation by the push button 12 in this state can be performed smoothly without any influence of the spring force of the opening spring 32 of the contact opening mechanism 3.

Next, description will be made in the case where the operation portion 1 and the switch portion 2 in the push button switch configured thus are released from coupling with each other for some reason so that the switch portion 2 drops off the operation portion 1 and the operation portion 1 and the switch portion 2 are imperfectly coupled with each other.

When the switch portion 2 is detached from the operation portion, the leading end of the body portion 11*a* of the operation portion case 11, which has contacted with the base side end portion of the lever 31 and applied pressure thereto till then, leaves the base side end portion of the lever 31. Thus, the lever 31 is released from restriction on its base side end portion so that the lever 31 becomes free.

FIGS. 13A2-13C2 and FIGS. 14A2-14C2 show the conditions of the switching contact units 24*a* and 24*b* with the normally open contact ("a" contact) configuration and the normally closed contact ("b" contact) configuration in this state.

Figure 9:
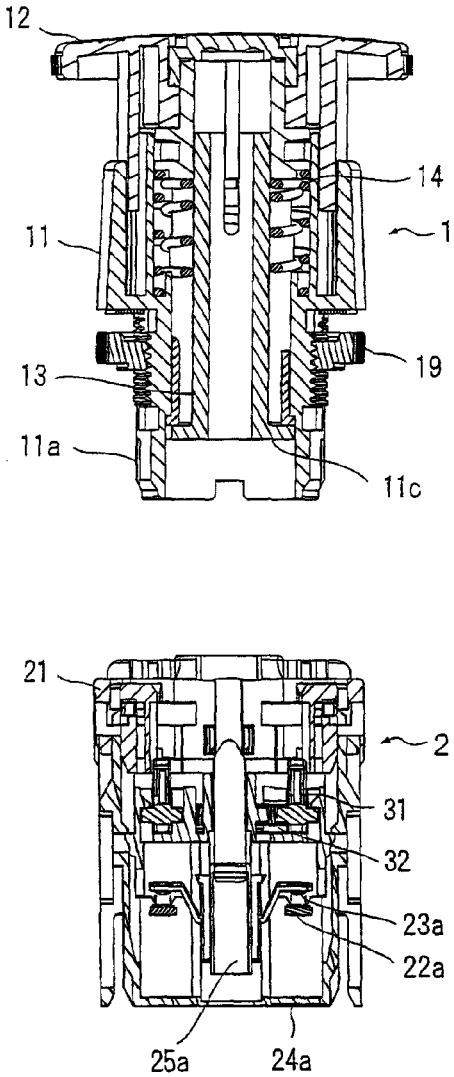
FIG. 9 is a sectional view taken on cutting line IV-IV in FIG. 1B and showing the state where the operation portion and the switch portion of the push button switch according to the first embodiment of the invention have been separated.
Figure 10:
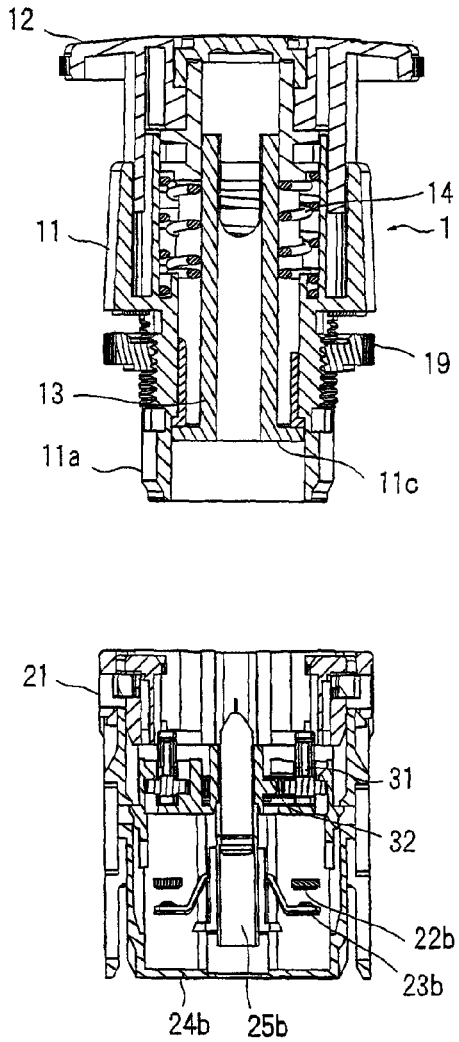
FIG. 10 is a sectional view taken on cutting line V-V in FIG. 1B and showing the state where the operation portion and the switch portion of the push button switch according to the first embodiment of the invention have been separated.

As is apparent from these drawings, when the switch portion 2 is detached from the operation portion 1, the leading end of the body portion 11*a* of the operation portion case 11 leaves the base side end portion of the lever 31 so as to make the lever 31 free. Thus, the lever 31 is rotated counterclockwise by the urging force of the opening spring 32. With the rotation of the lever 31, the pressure piece 31*d* of the leading end portion of the lever 31 moves downward to abut against the spring bearing piece 25*c* of the movable frame 25 of the switching contact mechanism 24*c* so as to push down the spring bearing piece 25*c*. As a result, the movable frame 25 moves down against the return spring 26. Together with the movable frame 25, the movable contact maker 27*a*, 27*b* supporting the movable contact also move down. Thus, in the switching contact unit 24*b* with the normally closed contact ("b" contact) configuration, the movable contact 23*b* leaves the fixed contact 22*b* to form an OFF state (FIGS. 14A2 and 10). On the other hand, in the switching contact unit 24*a* with the normally open contact ("a" contact) configuration, the movable contact 23*a* moves down to approach the fixed contact 22*a*. However, the push-down distance of the lever 31 is limited not to reach the position where the movable contact 23*a* contacts with the fixed contact 22*a*. Thus, the OFF state is kept while the movable contact 23*a* cannot contact with the fixed contact 22*a* (FIGS. 13A2 and 9).

Assume that the push button switch formed by coupling the switch portion with the operation portion in the state in which the switching contact unit configured thus and particularly having the normally closed contact ("b" contact) configuration has been built in the switch portion is used as a push button switch S for emergency stop of an instrument. Then, assume that there occurs an abnormal (incomplete coupling) condition where the switch portion 2 drops off the operation portion 1 in the state where the push button has been operated to be pushed in to turn off the contacts to issue an instruction of emergency stop. Even in this case, the movable contact which should be returned to contact with the fixed contact can be forcedly separated from the fixed contact and turned off by the contact opening mechanism 3. Thus, it is possible to prevent a risk that the emergency stop instruction may be canceled.

This embodiment has shown switching contact units each having a set of switching contacts. However, the invention is not limited to such a configuration. A switching contact unit having plural sets of switching contacts may be used as a switching contact unit in the switch portion. An embodiment thereof will be described later.

Next, an embodiment of application about the contact opening mechanism 3 provided in the switching contact unit 24 (see FIGS. 11 and 12) according to the first embodiment will be described with reference to FIGS. 15-17. In the embodiment of application, the opening spring (torsion coil spring) 32 additionally provided in the lever 31 of the contact opening mechanism 3 is replaced by opening springs each consisting of a compression coil spring.

Figure 15:
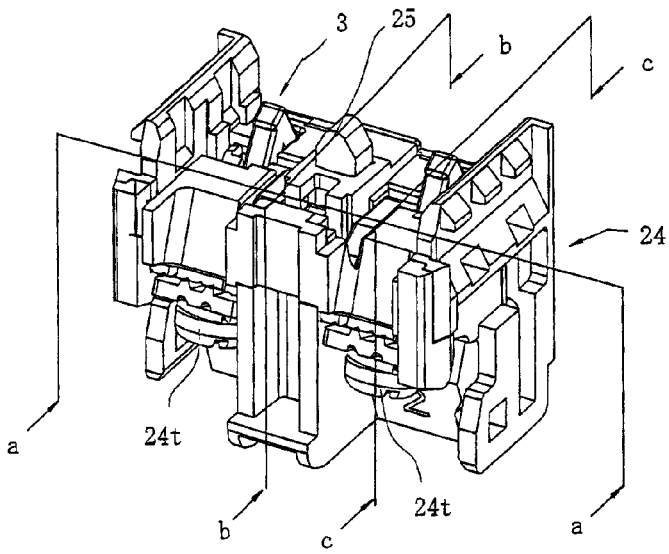
FIG. 15 is a perspective view showing the external appearance of a switching contact unit having a contact opening mechanism for use in a second embodiment of the invention.
Figure 16:
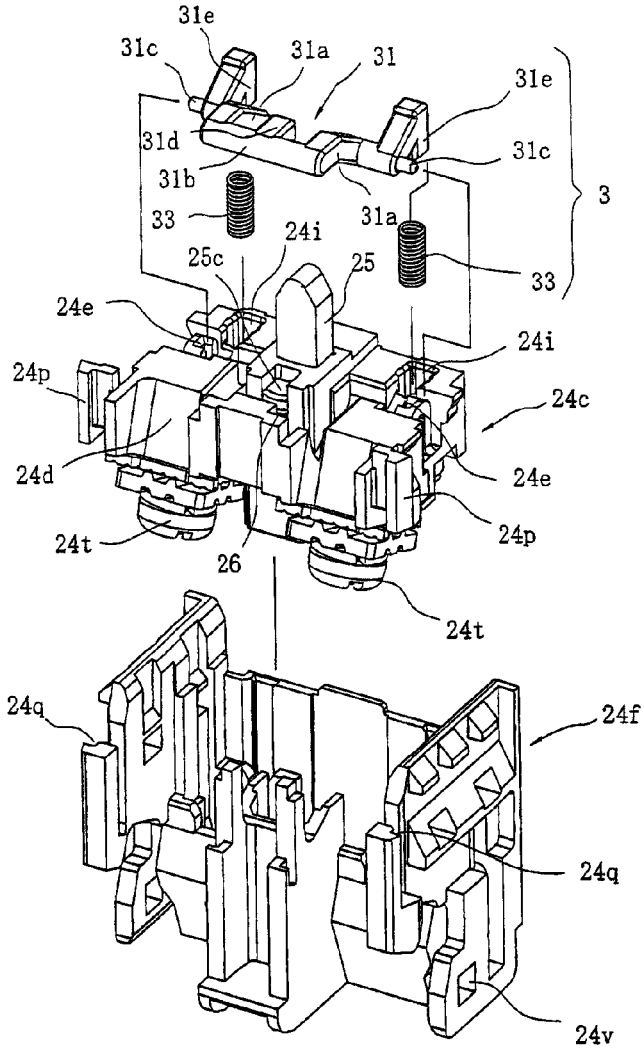
FIG. 16 is an exploded perspective view showing the switching contact unit having the contact opening mechanism for use in the second embodiment of the invention.

FIG. 15 is a perspective view showing the external appearance of the switching contact unit which has been assembled. FIG. 16 is an exploded perspective view of FIG. 15. FIGS. 17A1-17A2 to 17C1-17C2 are views showing the operation of a normally closed contact ("b" contact) configuration mounted on the switching contact unit. Members corresponding to those in FIGS. 11 and 12 and FIGS. 14A1-14A2 to 14C1-14C2 are referred to by the same numerals correspondingly.

That is, in this embodiment, an opening spring 33 consisting of a compression coil spring is put between an end portion 31*e* on the opposite side to the connector arm 31*b* with respect to the rotary shaft 31*c* in each rotary arm 31*a* of the lever 31 and the case 24*d* of the switching contact mechanism 24*c*. The opening spring 33 is inserted into a recess portion 24*i* (see FIG. 16) formed in the case 24*d* and retained in a predetermined position.

Due to the aforementioned configuration, a counterclockwise urging force is always applied from the opening spring (compression coil spring) 33 to the lever 31 with the rotary shaft 31*c* as a fulcrum. In the state where the switch portion 2 has been coupled with the operation portion 1, the lower end of the body portion 11*a* (see FIGS. 3A and 3B) on the leading end side of the case 11 of the operation portion 1 inserted into the switch portion 2 is brought into abutment onto the end portion 31*e* of the lever 31 so as to push down the end portion 31*e* slightly against the urging force of the opening spring 33 in the same manner as in the first embodiment. Thus, in the state where the switch portion 2 has been coupled with the operation portion 1, the lever 31 is rotated clockwise with its rotary shaft 31*c* as a fulcrum. As a result, the pressure piece 31*d* provided on the connector arm 31*b* of the lever 31 moves upward to leave the spring bearing piece 25*c* of the movable frame 25 built in the switching contact mechanism 24*c*. Thus, the urging force applied to the movable frame 25 by the opening spring 33 is canceled.

Accordingly, in the state where the switch portion 2 has been coupled with the operation portion 1, the movable contact 23*b* contacts with the fixed contact 22*b* to form an ON state in the switching contact mechanism 24*b* having the normally closed contact ("b" contact) configuration, as shown in FIGS. 17A1-17C1.

When the push button 12 of the operation portion 1 is pushed in here to set an operating state, the movable frame 25 of the switching contact unit is pushed down by the push rod 13 working with the push button 12. Thus, the movable contact 23*b* leaves the fixed contact 22*b* to form an OFF state in the switching contact unit 24*b* having the normally closed contact ("b" contact) configuration as shown in FIGS. 17A2-17C2.

That is, in the state where the switch portion 2 has been perfectly coupled with the operation portion 1, in the lever 31 of the contact opening mechanism 3, the urging force of the opening spring 33 is borne by the end portion of the lever 31 joined to the body portion 11*a* (see FIGS. 3A and 3B) of the operation portion 1 so as to rotate the lever 31 counterclockwise. Thus, the urging force of the opening spring (compression coil spring) 33 is not transmitted to the movable frame 25 of the switching contact mechanism through the pressure piece 31*d* of the lever 31. Thus, the switching operation by the push button 12 in this state can be performed smoothly without any influence of the spring force of the opening spring 33 of the contact opening mechanism 3 in the same manner as in the first embodiment.

On the contrary, when the operation portion 1 and the switch portion 2 are released from coupling with each other for some reason so that the switch portion 2 drops off the operation portion 1, the leading end of the body portion 11*a* of the operation portion case 11, which has contacted with the base side end portion 31*e* of the lever 31 and pushed in the base side end portion 31*e* till then, leaves the base side end portion 31*e*. Thus, the lever 31 is released from restriction so that the lever 31 becomes free. As a result, the movable contact 23*b* in the normally closed contact ("b" contact) configuration is forced to leave the fixed contact 22*b* as shown in FIGS. 17A2-17C2, so as to form an OFF state. Thus, the same safety function as in the first embodiment can be exerted.

In addition, the compression coil spring as an opening spring of the lever 31 is put between the rear end portion 31*e* of the lever 31 and the case 24*d* of the switching contact mechanism, so that the opening spring can be installed more easily than in the configuration of the first embodiment where a torsion coil spring as an opening spring is additionally provided in the rotary shaft 31*c* of the lever 31. Even a mechanical assembling system using a robot can be therefore applied easily to the installation of the opening spring.

Figure 18:
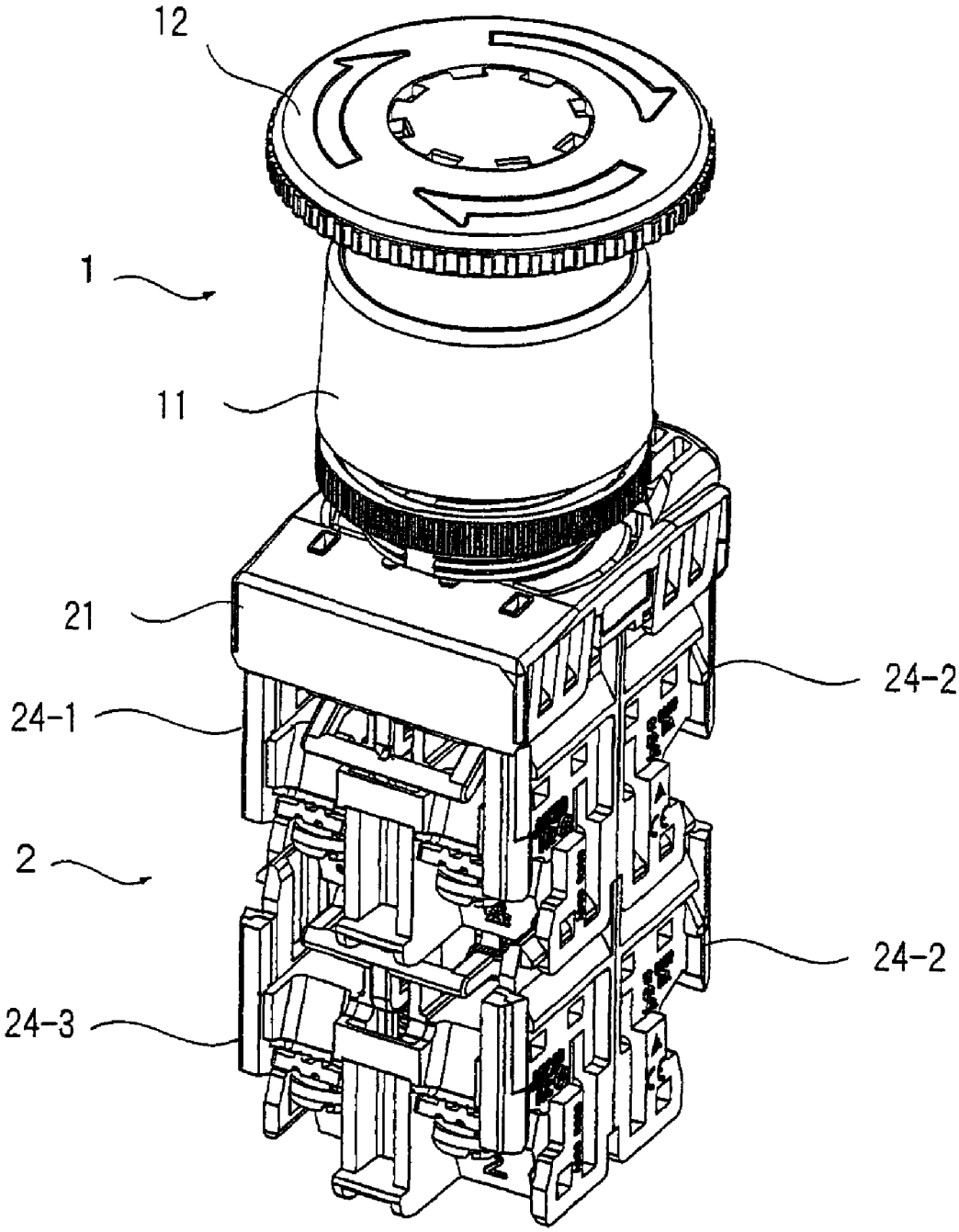
FIG. 18 is a perspective view showing a third embodiment of the invention.

Next, a third embodiment of the invention shown in FIG. 18 will be described. FIG. 18 is a perspective view showing the external appearance of this embodiment. A switch portion 2 coupled with an operation portion 1 in this embodiment has four switching contact units 24-1 to 24-4. The switching contact unit 24*a* with the normally open contact ("a" contact) configuration or the switching contact unit 24*b* with the normally closed contact ("b" contact) configuration shown in the first embodiment is used selectively as each switching contact unit. The switching contact units are coupled and connected in parallel and in series to each other and supported on a common switch portion case 21. In the switching contact units coupled in two stages and in series, movable frames supporting internal movable contacts and working with a push rod inside the operation portion 1 are connected to be able to work together. Thus, the push button switch can be allowed to operate a large number of switching contact circuits, and can be used, for example, when a plurality of emergency stop instructions have to be issued. The switching contact units 24 may be coupled in two or more plural stages.

Figure 19:
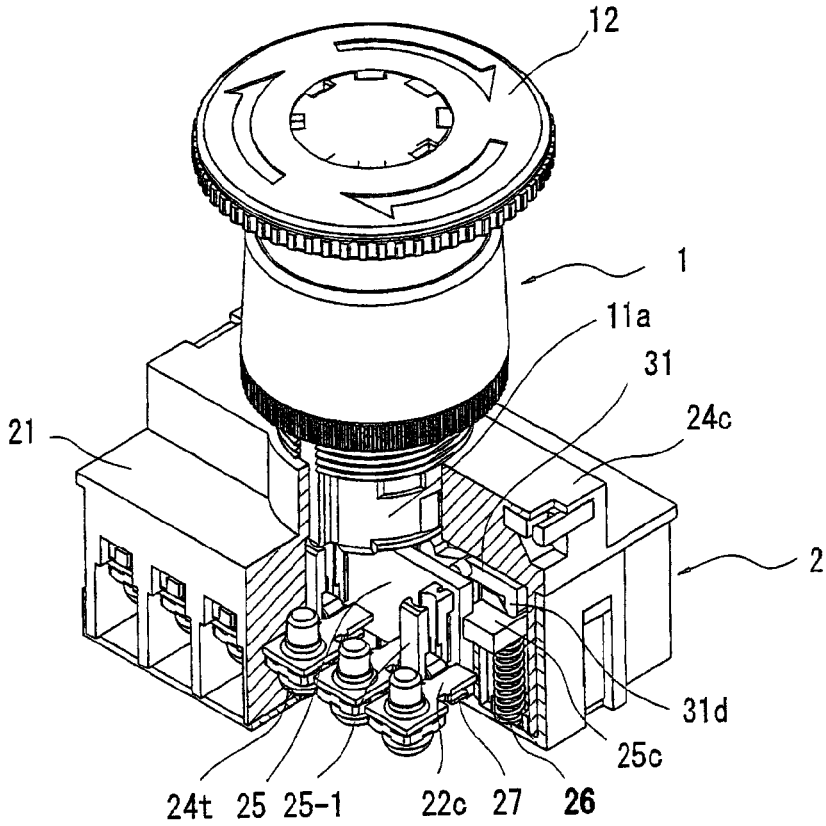
FIG. 19 is a perspective view showing a fourth embodiment of the invention.
Figure 20:
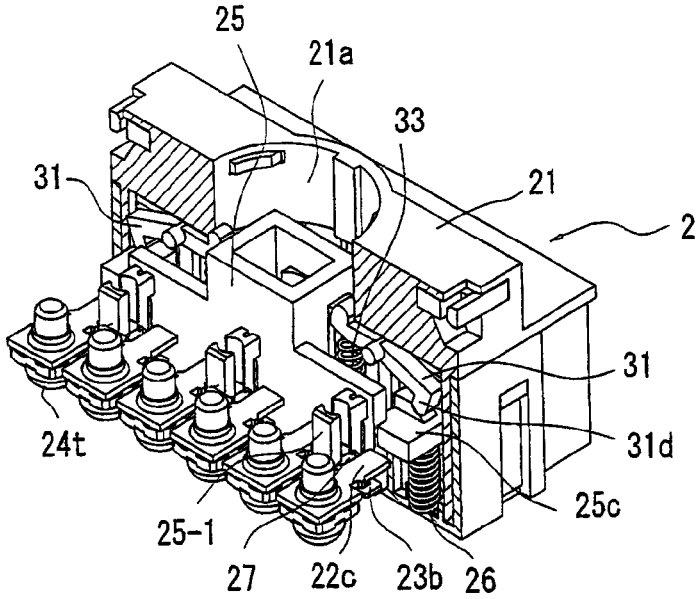
FIG. 20 is a partially cutaway perspective view of a switch portion for use in the fourth embodiment of the invention.
Figure 21:
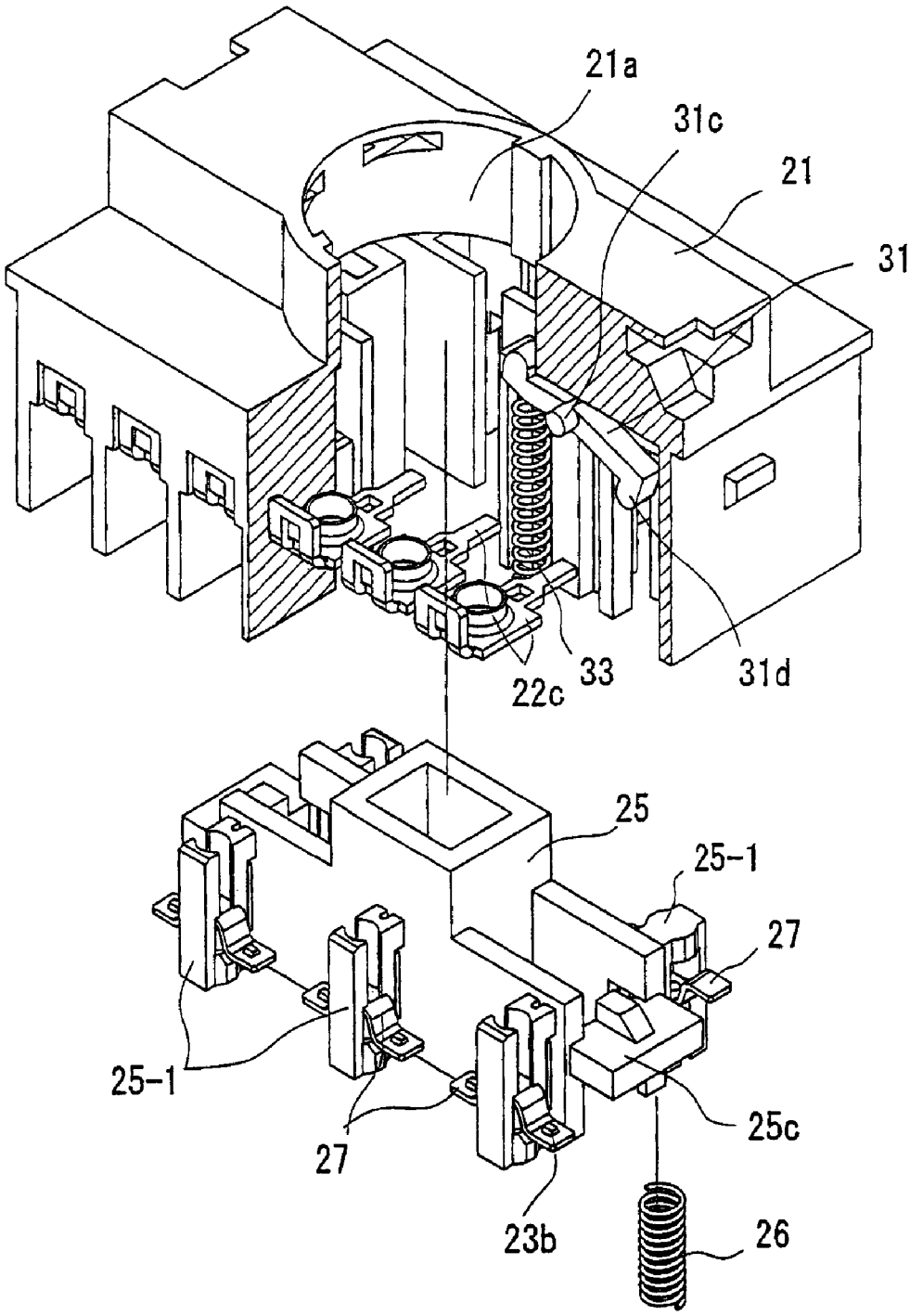
FIG. 21 is an exploded perspective view showing a main portion of the switch portion for use in the fourth embodiment of the invention.

Next, a fourth embodiment of the invention in which the assembling structure of the switch portion has been improved to make the push button switch small and compact will be described with reference to FIGS. 19-21.

The third embodiment showed a push button switch in which the plurality of switching contact units 24-1 to 24-4 having independent structures are provided in combination in the switch portion 2, the movable frame 25 of the contact switching mechanism and the contact opening mechanism 3 are provided in each switching contact unit and linked with the operation portion 1. In the fourth embodiment, however, plural sets of switching contacts (contact pairs with a normally open contact ("a" contact) configuration and/or contact pairs with a normally closed contact ("b" contact) configuration) are built in a switching contact unit with a single structure. At the same time, all the movable contacts of the respective switching contact sets are held collectively by a common movable frame, and a contact opening mechanism is combined with the common movable frame and linked with the operation portion.

That is, in this embodiment, a total of six sets of switching contacts, three of which are arranged in the front rank and the other three of which are arranged in the rear rank, are built in a box-like switch portion case 21. In the illustrated structure, three normally closed contact pairs ("b" contacts) are disposed laterally in the front rank of the switch portion case 21, and three normally open contact pairs ("a" contacts) are disposed likewise in the rear rank. Here, each set of switching contacts consists of a combination of two fixed contact makers 22*c* and a movable contact maker 27*a*. That is, for each set of switching contacts, adjacent two of fixed contact makers 22*c* with leading-out terminals 24*t* arranged laterally and fitted to and retained in the switch portion case 21 are paired, and a movable contact maker 27*a* of a bridging type is disposed perpendicularly to the adjacent fixed contact makers 22*c*. In addition, the movable contact makers 27 of the respective sets are combined with contact springs and fitted into and retained in contact maker holders 25-1 which are formed to protrude in front and at the rear of a common movable frame 25.

In addition, the common movable frame 25 has a cylindrical convex portion which protrudes upward from its central portion. The cylindrical convex portion is disposed to face a fitting hole 21*a* opened in the upper surface of the switch portion case 21. Further, on the opposite, left and right sides of the movable frame 25, two seesaw levers 31 serving as contact opening mechanisms are provided in combination with opening springs 33 which are compression coil springs.

In the state where the switch portion 2 has been coupled with the operation portion 1 (see FIG. 19), the body portion 11*a* of the operation portion 1 abuts against end portions 31*e* of the levers 31 from above so as to push in the end portions of the two levers 31 concurrently against the opening springs 33. As a result, the levers 31 rotate with their rotary shafts 31*c* as fulcrums. Pressure pieces 31*d* of the levers 31 leave spring bearing pieces 25*c* protruding from the opposite, left and right ends of the movable frame 25 so as to cancel the spring urging forces of the opening springs 33 acting on the movable frame 25. As a result, the movable frame 25 and the movable contact makers 22*c* of the respective sets retained in the movable frame 25 are pushed up by spring urging forces of return springs 26 applied thereto. Thus, the normally open switching contacts ("a" contacts) are turned on, while the normally closed switching contacts ("b" contacts) are turned off. When the push button 12 of the operation portion 1 is pushed in during this state, the push rod linked with the push button 12 pushes in the movable frame 25 directly to change over the respective sets of switching contacts.

On the other hand, when the operation portion 1 and the switch portion 2 are released from coupling with each other so that the switch portion 2 drops off the operation portion 1, the spring urging forces of the opening springs 33 are applied to the levers 31 so that the levers 31 swing and return with the result that the pressure pieces 31*d* at the leading ends of the levers 31 push in the spring bearing pieces 25*c* of the movable frame. As a result, the movable frame 25 moves down against the return springs 26 and turns off all the sets of switching contacts. This operation and function are the same as that described in the first and second embodiments.

That is, when the push button 12 has not been pushed in the state where the switch portion 2 has been coupled with the operation portion 1, the normally closed contacts ("b" contacts) are ON, and the normally open contacts ("a" contacts) are OFF. When the push button 12 is pushed in, the normally closed contacts are turned off, and the normally open contacts are turned on. When the operation portion 1 and the switch portion 2 are accidentally released from coupling with each other so that the switch portion drops off the operation portion, both the normally open contacts and the normally closed contacts are turned off as described in FIGS. 13A1-13A2 to 13C1-13C2 and FIGS. 14A1-14A2 to 14C1-14C2. Thus, the coupling state and the dropping-off state between the operation portion 1 and the switch portion 2 can be identified and detected from on/off signals of the plural sets of switching contacts (normally open contacts and normally closed contacts) mounted on the switch portion 2.

The switch portion according to this embodiment is designed so that plural sets of switching contacts and a movable frame shared by the respective sets of switching contacts are mounted on one switching contact unit. Accordingly, the switch portion can be made small and compact in comparison with that in the third embodiment where a plurality of independent switching contact units are combined and coupled in the switch portion.

Although three sets of normally closed contacts and three sets of normally open contacts are arrayed in the front and rear ranks respectively in the switch portion case 21 in the illustrated embodiment, the number of installed sets of switching contacts and the combination of normally open and normally closed contacts are not limited thereto but may be selected desirably.

In each push button switch according to the first to fourth embodiments, the operation portion of the push button is attached to a panel such as a control panel and the switch portion is connected to the back of the operation portion so that the push button switch in use is connected to wires (lead wires) of the panel. Besides the push button switch, there is also known a box-mounted push button switch which is configured as follows. That is, an operation portion and a switch portion of a push button switch are incorporated into an independent operation box. This operation box is attached to a panel front surface etc. of a control panel. Then, electric wires connected to the switch portion are led out from the operation box, and connected externally.

This box-mounted push button switch is configured in the following manner. The operation box (this operation box is provided as an optional component to a user) is consisted of a resin molding which has a split structure of a base and a cover. The operation portion is attached to the cover of the box, and an assembly of the switch portion is incorporated into the base. Then, external wires connected to terminals of the switch portion are led sideways from the base.

Figure 22:
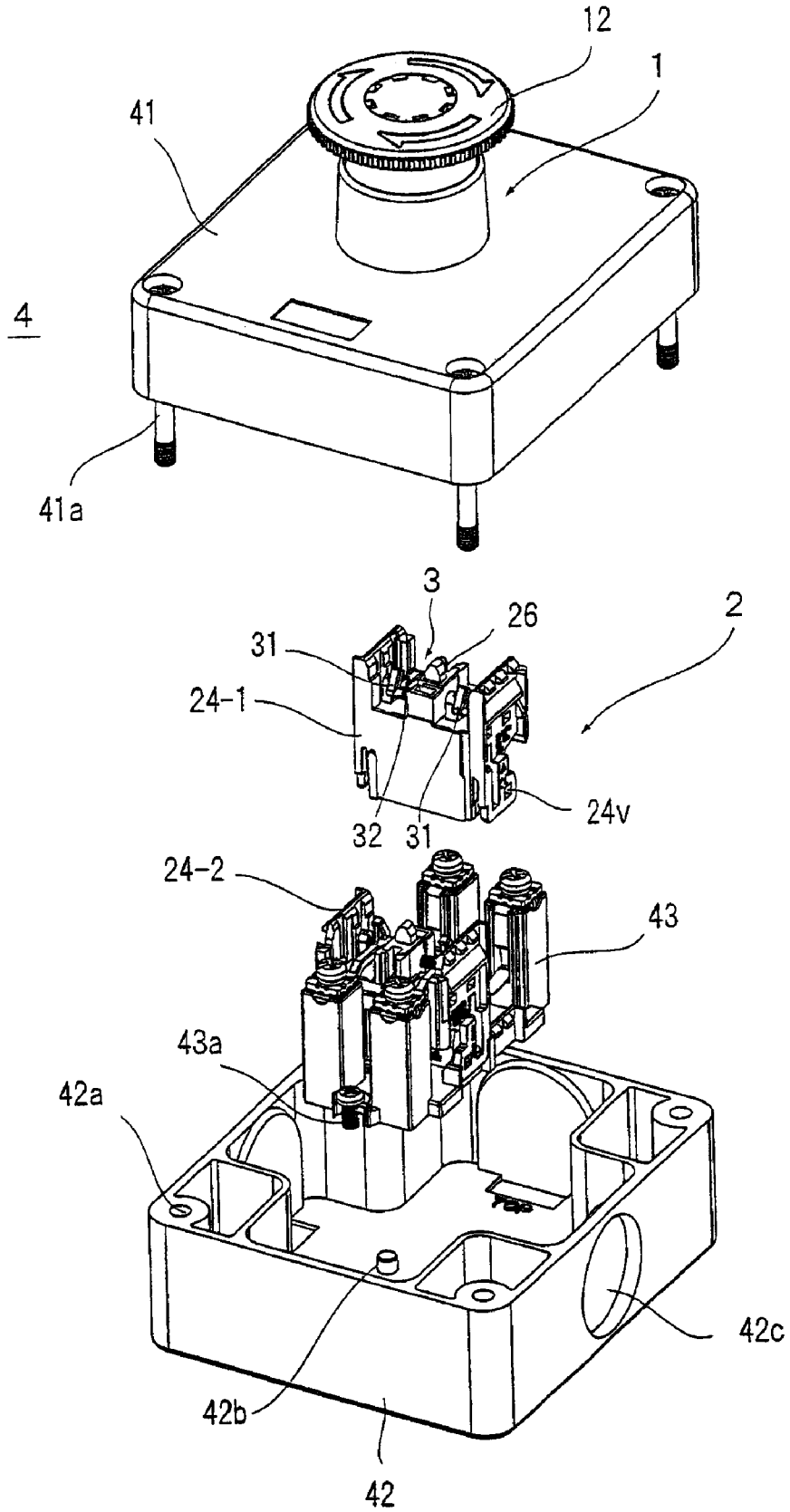
FIG. 22 is an exploded perspective view showing a box-mounted push button switch according to a fifth embodiment of the invention.
Figure 23A:
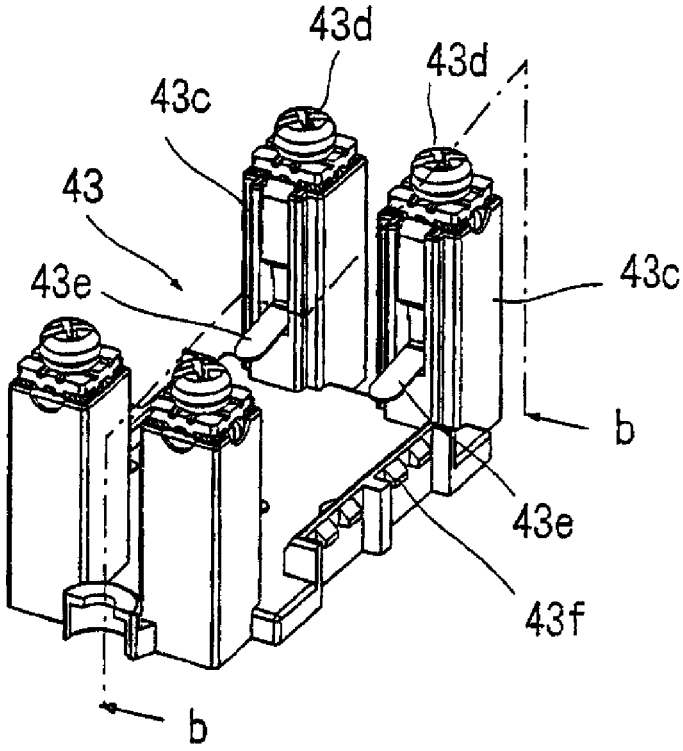
FIG. 23A is a perspective view showing a terminal base for use in the fifth embodiment of the invention.
Figure 23B:
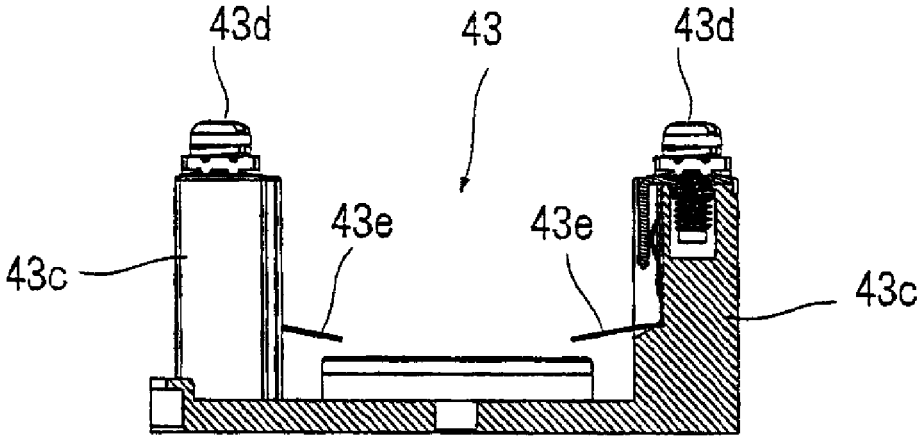
FIG. 23B is a sectional view taken on cutting line b-b in FIG. 23A.
Figure 24:
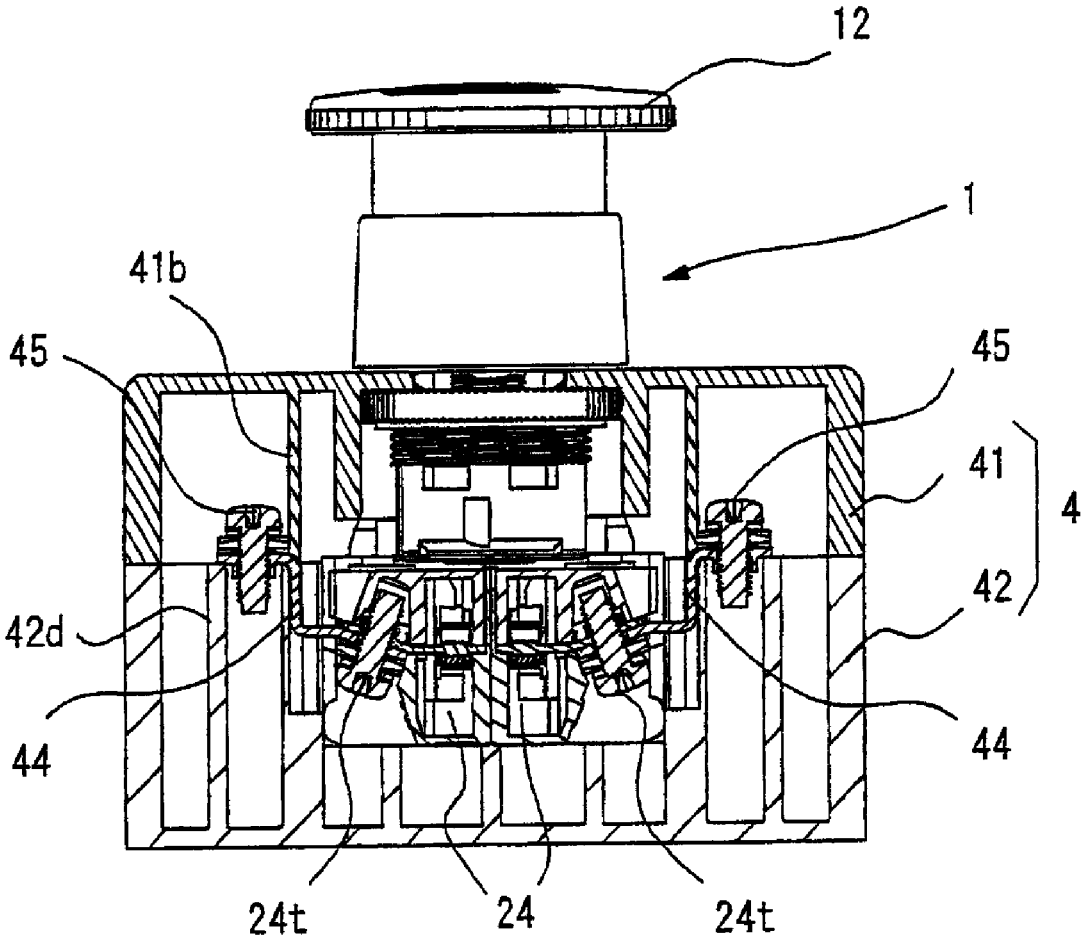
FIG. 24 is a side sectional view showing an assembling structure of a box-mounted push button switch according to a sixth embodiment of the invention.
Figure 25A:
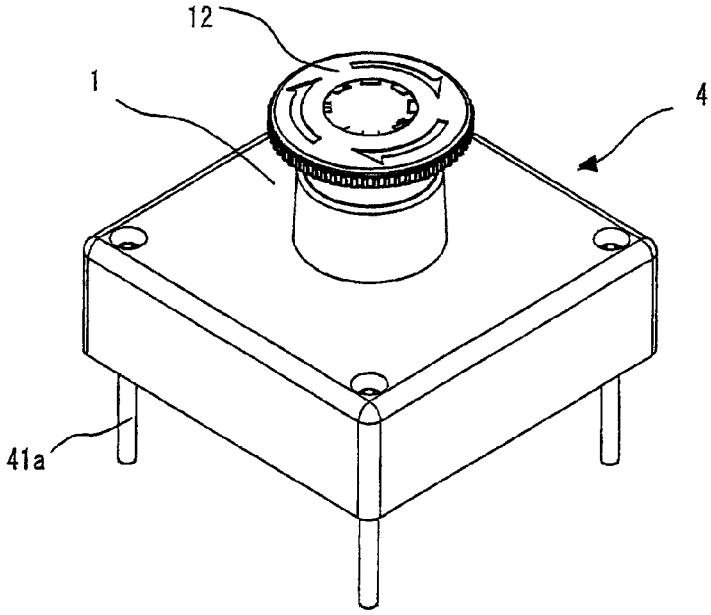
FIGS. 25A to 25C are exploded views showing the structure according to the sixth embodiment of the invention, FIG. 25A being a perspective view showing a state in which an operation portion of the push button switch is installed in a cover of a box, FIG. 25B being a perspective view showing an assembly of a switch portion, and FIG. 25C being a perspective view showing a temporarily assembled state in which the assembly of the switch portion shown in FIG. 25B is received in a base of the box.
Figure 25B:
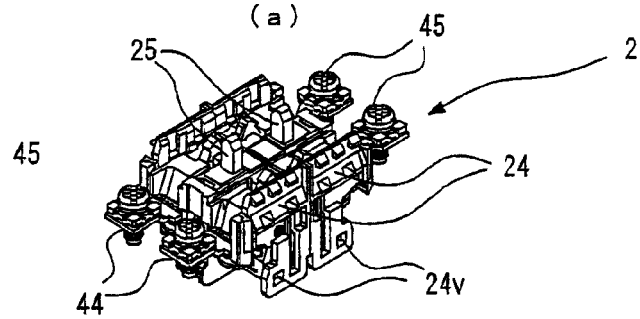
Figure 25C:
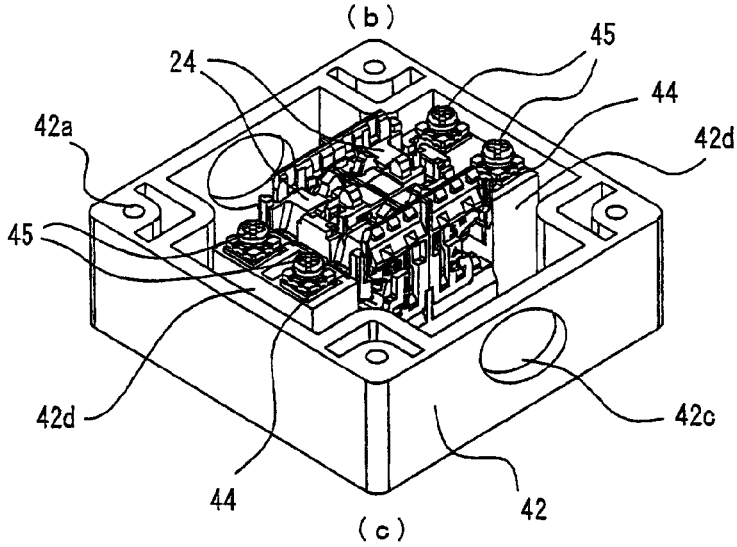

Next, FIG. 22 and FIGS. 23A and 23B show a fifth embodiment of the invention applied to the box-mounted push button switch. In the fifth embodiment, the box-mounted push button switch is formed as follows. That is, an operation portion 1 and a switch portion 2 of a push button switch are received in an operation box 4 made of a resin molding. Here, the operation box 4 is divided into a cover 41 and a base 42 as shown in FIG. 22. The cover 41 and the base 42 are put on top of each other, and fastening screws 41*a* inserted into the cover 41 are screwed down into threaded holes 42*a* of the base 42 so as to couple the cover 41 and the base 42 integrally.

The operation portion 1 of the push button switch is provided with the push button 12 and attached to the cover 41. The switch portion 2 is attached to the base 42. Since the switch portion 2 according to the first embodiment cannot be attached as it is, a terminal base 43 is used in the embodiment.

The terminal base 43 is fixed to the base 42 by a mounting screw 43*a* which is screwed down into a threaded hole 42*b*. As shown in detail in FIGS. 23A and 23B, screw connection terminals 43*d* are provided in four corners of the terminal base 43, and a cavity to mount the switching contact unit 24 therein is provided in the middle portion of the terminal base 43. Each connection terminal portion is provided with a contact piece 43*e* consisting of an L-shaped elastic conductive plate which is electrically connected to corresponding one of the screw connection terminals 43*d*, as shown in FIG. 23B. When the switching contact unit 24 is mounted on the terminal base 43 as shown in FIG. 22, the contact pieces 43*e* contact with the leading-out terminals 24*t* (see FIG. 11) of the switching contact unit 24 so as to conductively connect the leading-out terminals 24*t* of the switching contact unit 24 to the screw connection terminals 43*d*. Incidentally, in the state in which the cover 41 has been removed, the electric wires connected externally are led into the inside of the base through a lead hole 42*c* opened in a side wall of the base 42, and connected to the screw connection terminals 43*d*.

The switching contact unit 24 used in the switch portion 2 shown in the first embodiment can be used directly as the switching contact unit 24 here. Each engagement hook 43*f* provided in a side surface of the terminal base 43 is engaged with a fitting recess 24*a* provided in a side surface of the switching contact unit 24. Thus, the switching contact unit 24 mounted on the terminal bases 43 is fixed to the terminal bases 43. In the configuration of this embodiment, two switching contact units 24 can be mounted. However, the embodiment may be arranged so that two or more switching contact units 24 are mounted. Moreover, a switching contact unit having plural sets of switching contacts in one switching contact unit may be used as described in the fourth embodiment.

The switch portion 2 formed by mounting a required number of switching contact units 24 on terminal bases 43 is attached and fixed into the base 42 of the operation box 4. The base 42 is covered with the cover 41 to which the operation portion 1 is attached. The cover 41 is fastened and coupled with the base 42 by the fastening screws 41*a*. Thus, the operation box 4 is completed. At the same time that the base 42 is covered with and coupled with the cover 41, the operation portion 1 and the switch portion 2 of the push button switch can be also coupled.

For this reason, when the cover 41 and the base 42 of the operation box 4 are fastened insufficiently or when the cover 41 is put off carelessly because of maintenance or the like during the operation of emergency stop, coupling between the operation portion 1 and the switch portion 2 of the push button switch becomes imperfect. Assume that coupling between the operation portion 1 and the switch portion 2 of the push button switch becomes imperfect in this manner. Then, because the contact opening mechanism 3 is provided in the switching contact unit 24 in the switch portion 2 in the same manner as in the first embodiment, the contact opening mechanism 3 can detect the incomplete coupling between the operation portion 1 and the switch portion 2 and forcedly open the normally closed contacts of the switching contact unit having a normally closed contact ("b" contact) configuration. Accordingly, when the push button switch received in the operation box is used as a switch for emergency stop, there is no fear that an emergency stop instruction is canceled carelessly even if there occurs an accident in which the switch portion drops off the operation portion. Thus, safety can be secured.

Next, FIG. 24, FIGS. 25A to 25C, and FIGS. 26A to 26C show a sixth embodiment of the invention in which the assembling structure of the box-mounted push button switch according to the fifth embodiment is further improved.

That is, in the configuration of the fifth embodiment (see FIG. 22 and FIGS. 23A and 23B), the terminal base 43 as an independent component is placed in the base 42 of the operation box 4 and the terminal base 43 is screwed down to the bottom portion of the base 42 by the mounting screw 43*a*. In addition, the screw connection terminals 43*d* used for connection to external wires and the contact pieces 43*e* electrically connected to the leading-out terminals 24*t* of the switching contact units 24 are provided in the terminal base 43. Then, the assembly of the switch portion 2 is fitted and fixed into the cavity in the middle portion of the terminal base 43. For this reason, in the assembling structure according to the fifth embodiment, the structure of the terminal base 43 used for incorporating the switch portion 2 into the operation box 4 is so complicated that there remains a problem that the number of components and the assembling man-hours are increased.

Accordingly, the sixth embodiment is to improve the problem. In this embodiment, the terminal base 43 attached as a separate component (see FIG. 22) to the base 42 according to the fifth embodiment is not used. The assembly of the switch portion 2 is incorporated into the operation box 4. The external wires led into the operation box 4 are connected to the terminals of the switch portion 2. Incidentally, in the embodiment, the switch portion 2 is formed by combining two switching contact units 24 in the same manner as in the first embodiment.

That is, in the sixth embodiment, a recess cavity into which the assembly of the switch portion 2 is fitted in a drop-in manner is formed in the inside of the base 42 of the operation box 4. Terminal base portions 42*d* for holding relay terminal fittings which will be described later are formed integrally on left and right sides of the base 42 with the cavity being interposed therebetween. In addition, Z-shaped relay terminal fittings 44 (see FIG. 26) are attached to the switching contact units 24 constructing the assembly of the switch portion 2. One end of each relay terminal fitting 44 is connected to a corresponding leading-out terminal 24*t* disposed on a lower surface side of a corresponding switching contact unit 24, while the other end thereof is led to an upper surface side of the base 42. Terminal screws 45 used for connection to external wires are provided at the tips of the relay terminal fittings 44. Incidentally, each relay terminal fitting 44 is made of a copper plate which is punched out by press working and bent into L-shapes in its opposite ends respectively so as to be formed into a Z-shape. The relay terminal fitting 44 includes a threaded hole 44*a* into which the terminal screw 45 is screwed down, and a screw insertion hole 44*b* into which the leading-out terminal 24*t* (terminal screw) of the switching contact unit 24 is inserted.

Figure 26A:
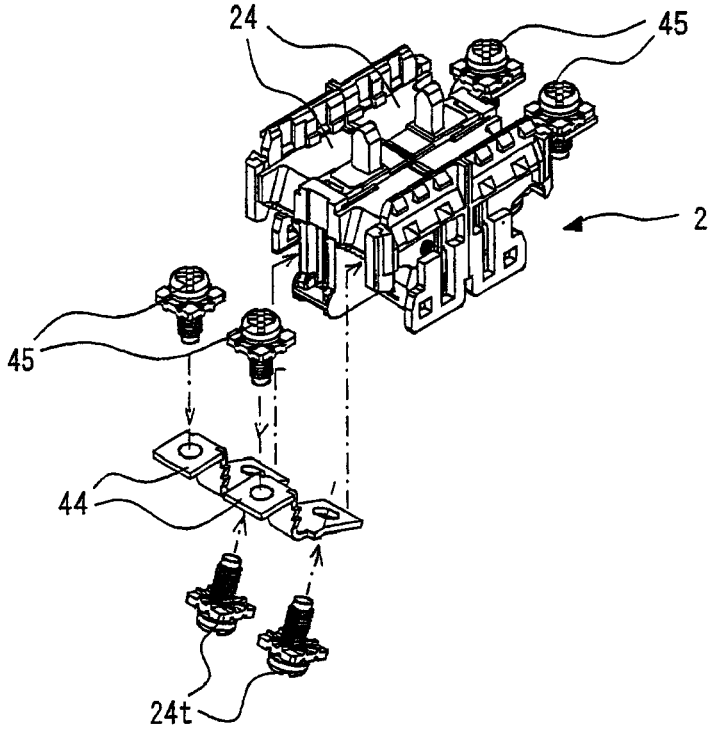
FIGS. 26A and 26B are detailed structure views showing the switch portion for use in the sixth embodiment of the invention, FIG. 26A being an exploded perspective view showing a leading-out terminal portion, FIG. 26B being a perspective view showing a relay terminal fitting shown in FIG. 26A, and FIG. 26C being a sectional view showing a temporarily assembled state in which the switch portion is received in the base of the box.
Figure 26B:
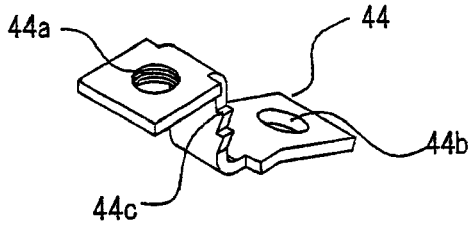
Figure 26C:
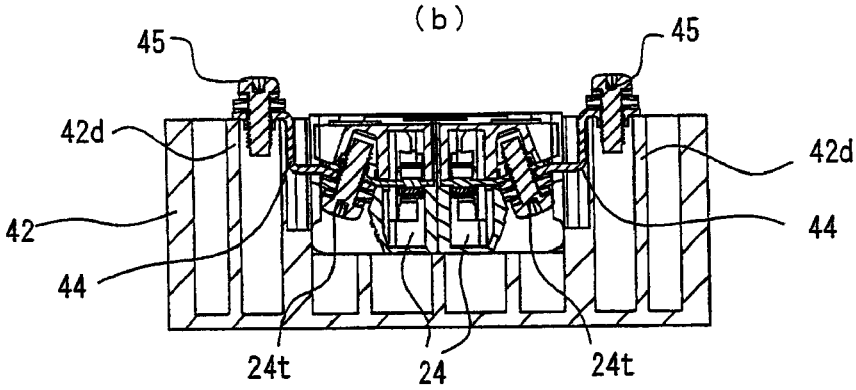

When the assembly of the switch portion 2 is dropped in from above and fitted into the center of the base 42 of the operation box 4 in the condition that the relay terminal fittings 44 are attached to the switching contact units 24 as shown in FIGS. 26A to 26C, front end portions of the relay terminal fittings 44 are held on the terminal bases 42*d* formed in the inside of the base 42 so that the switch portion 2 is temporarily retained in a predetermined position in the base (see FIG. 26C). On the other hand, the operation portion 1 provided with the push button 12 is attached to the cover 41 of the operation box 4 in the same manner as in the fifth embodiment. Moreover, in the embodiment, wall-shaped press ribs 41*b* are molded integrally with an inner side of the cover 41 so as to be opposed to the terminal bases 42*d* of the base 42.

When the base 42 of the operation box 4 is covered with the cover 41 in the temporarily assembled state and the fastening screws 41*a* inserted into the cover 41 are screwed down into the threaded holes 42*a* of the base 42 so as to couple the cover 41 and the base 42 integrally, the top portions of the relay terminal fittings 44 are interposed between the press ribs 41*b* of the cover 41 and the terminal bases 42*d* of the base 42 from above and below so as to be held and fixed in these positions. At the same time, the operation portion 1 and the switch portion 2 are set to be coupled. Thus, the box-mounted push button switch is completed. In addition, to externally connect electric wires to the push button switch, the electric wires are led into the inside of the base through the lead hole 42*c* opened in the side wall of the base 42, and connected to the terminal screws 45 in the state in which the cover 41 has been removed in the same manner as in the fifth embodiment. In this case, the terminal screws 45 are disposed on the upper surface side of the base 42 so that the operation of wiring can be performed easily.

According to the configuration of the sixth embodiment, the terminal base 43 (see FIG. 22) as an independent component does not have to be additionally installed on the base 42 side of the operation box 4 as described in the fifth embodiment. Nevertheless the operation portion 1 and the switching contact units 24 of the switch portion 2 can be used as common components and incorporated into the operation box 4 in a screwless manner. On this occasion, the operation portion 1 and the switching contact units 24 have the same structures as those in the push button switch according to the first embodiment, which is attached to the control panel in use. Thus, the number of components and the assembling man-hours can be reduced. For example, assume that a user wants to combine an additionally purchased operation box (optional component) with the existing operation portion and the existing switch portion to thereby construct a box-mounted push button switch. Even in such a case, the box-mounted push button switch can be constructed with a simple operation.

In this embodiment, the following structure is used for the purpose of enhancing convenience of an assembling operation for incorporating the switch portion 2 into the base 42 of the operation box 4. That is, sawtooth-like engagement protrusions 44*c* (see FIG. 26B) are formed on left and right edges in an upstand portion of each relay terminal fitting 44 and vertical grooves into which the engagement protrusions 44*c* are pressed are formed in the terminal base 42*d* of the base 42. Thus, when the assembly of the switch portion 2 is incorporated into the base 42 of the operation box 4, the engagement protrusions 44*c* of the relay terminal fittings 44 are pressed into the grooves of the terminal bases 42*d*. Thus, the switch portion 2 can be retained and held in the temporary assembling position easily.

In addition, in the push button switch according to the fifth embodiment, two switching contact units 24 are used to form the switch portion 2. However, three or more switching contact units 24 may be used in combination to form one switch portion 2. In addition, as described in the fourth embodiment, a switching contact unit provided with plural sets of switching contacts may be used as one switching contact unit. Moreover, the contact opening mechanism 3 described in the first embodiment is installed in each switching contact unit 24 of the switch portion 2. When the box-mounted push button switch is used as an emergency stop switch, even if a situation occurs that the cover 42 of the operation box 4 is loosened or removed unexpectedly to thereby release the operation portion 1 and the switch portion 2 from coupling with each other, there is no fear that an emergency stop instruction is cancelled carelessly. Thus, high safety can be ensured.

Incidentally, the contact opening mechanism 3 is internally incorporated into the switch portion 2 in the first embodiment, however, the box-mounted push button switch in which the switch portion 2 is received in the operation box 4 may be configured so that the contact opening mechanism is provided outside the switch portion 2 by use of an internal space of the operation box 4.

Figure 27A:
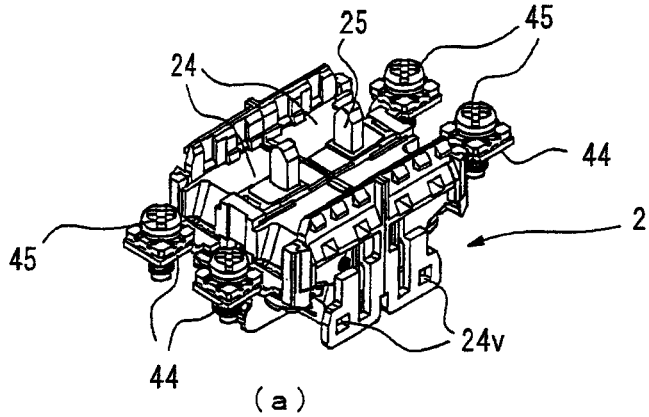
FIGS. 27A to 27C are exploded views showing a main part assembling structure of a box-mounted push button switch according to a seventh embodiment of the invention, FIG. 27A being a perspective view showing an assembly of a switch portion, FIG. 27B being a perspective view showing an attachment frame in which the assembly of the switch portion shown in FIG. 27A is retained and held in a bottom portion of a base of a box, and FIG. 27C being a perspective view showing the base of the box.
Figure 27B:
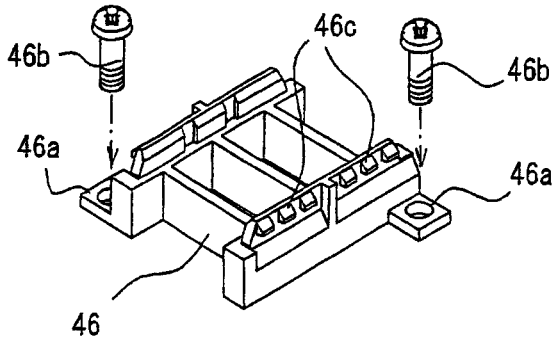
Figure 27C:
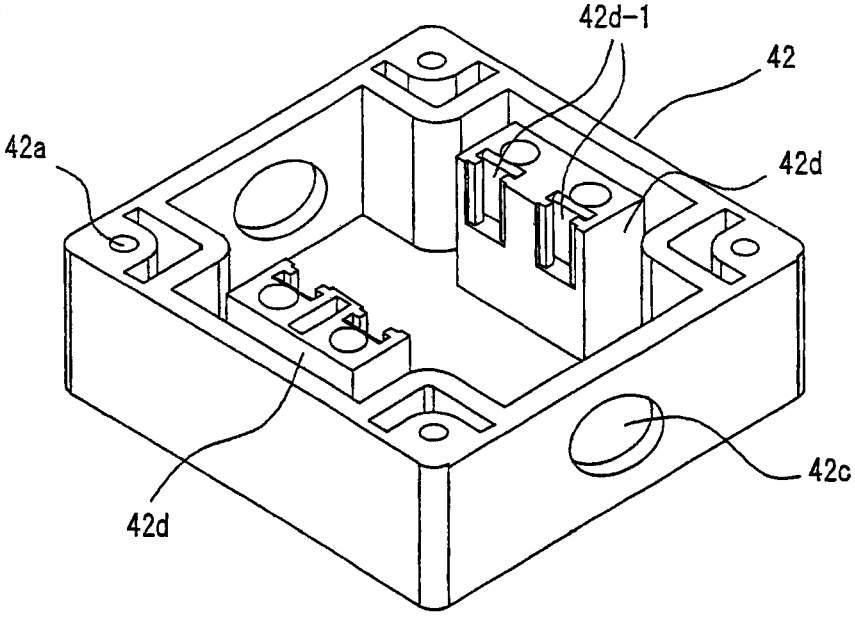
Figure 28A:
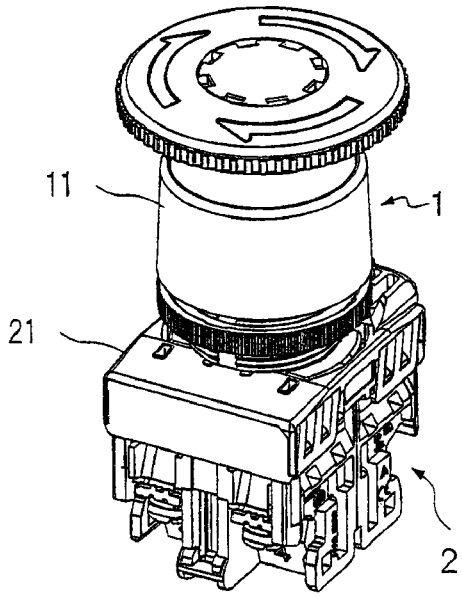
FIG. 28A Prior Art
FIG. 28A is a perspective view showing the configuration of a conventional push button switch.
Figure 28B:
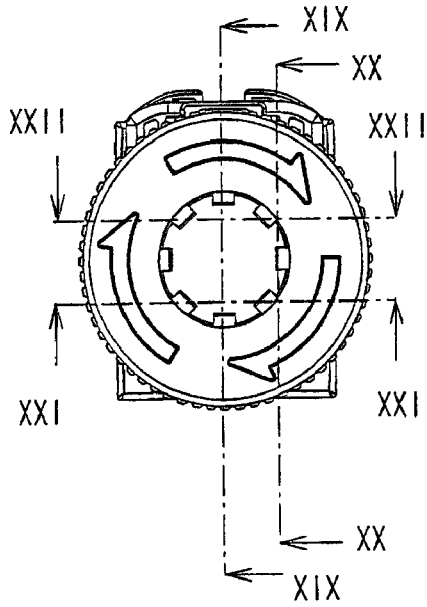
FIG. 28B Prior Art
FIG. 28B is a plan view of the same.
Figure 29A:
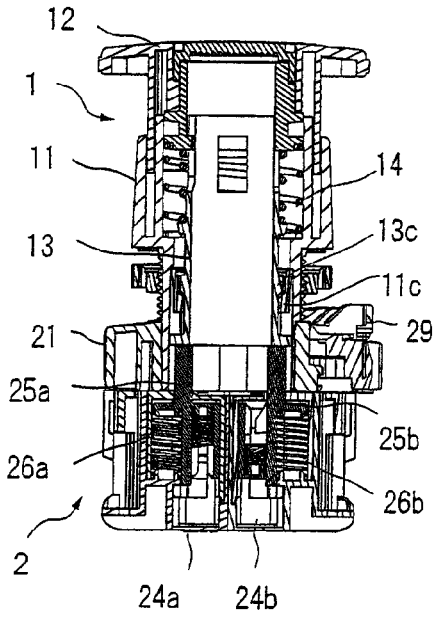
FIG. 29A Prior Art
FIG. 29A is a sectional view taken on cutting line XIX-XIX in FIG. 28B and showing a standby state of the conventional push button switch.
Figure 29B:
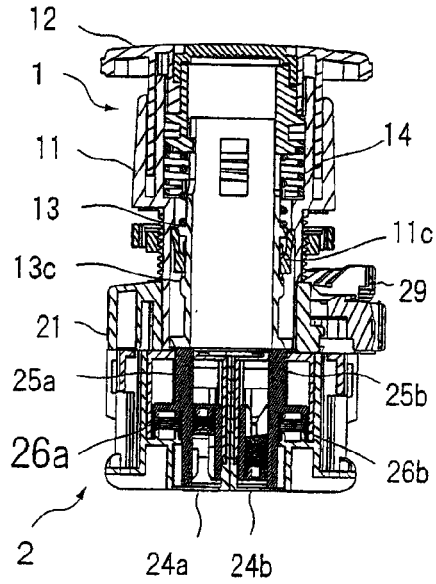
FIG. 29B Prior Art
FIG. 29B is a sectional view likewise showing an operating state of the same.
Figure 30A:
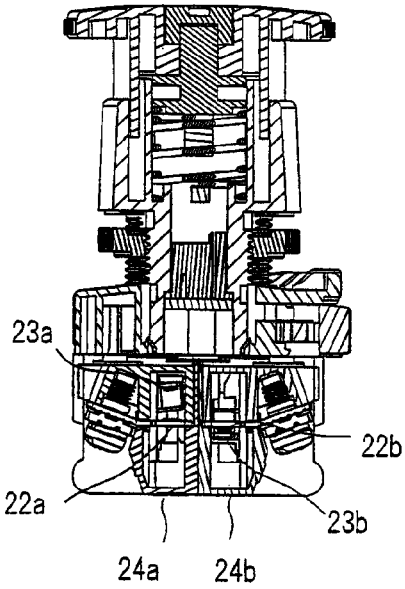
FIG. 30A Prior Art
FIG. 30A is a sectional view taken on cutting line XX-XX in FIG. 28B and showing the standby state of the conventional push button switch.
Figure 30B:
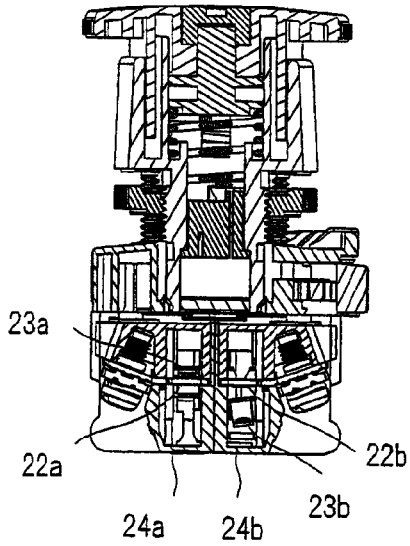
FIG. 30B Prior Art
FIG. 30B is a sectional view likewise showing the operating state of the same.
Figure 31A:
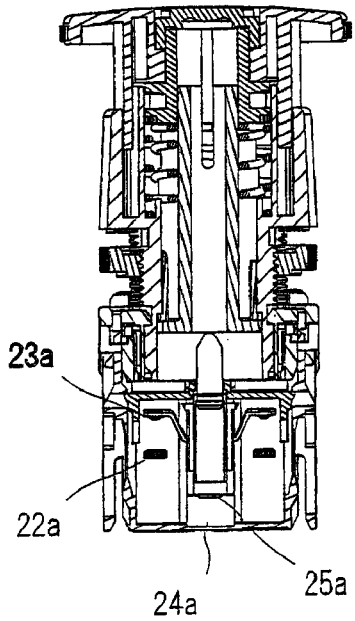
FIG. 31A Prior Art
FIG. 31A is a sectional view taken on cutting line XXI-XXI in FIG. 28B and showing the standby state of the conventional push button switch.
Figure 31B:
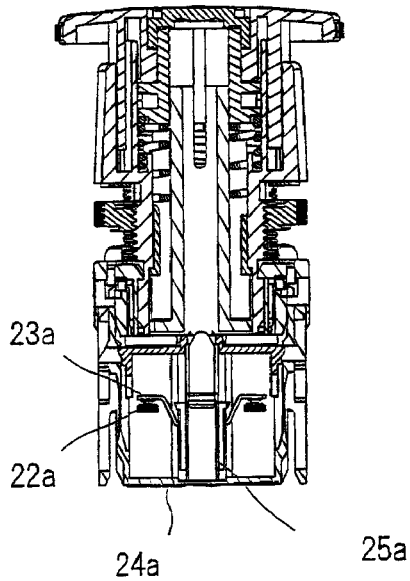
FIG. 31B Prior Art
FIG. 31B is a sectional view likewise showing the operating state of the same.
Figure 32A:
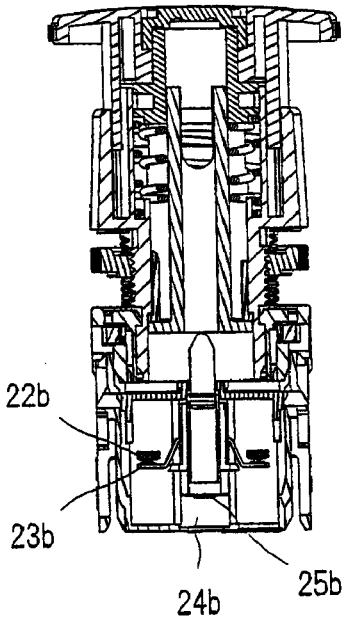
FIG. 32A Prior Art
FIG. 32A is a sectional view taken on cutting line XXII-XXII in FIG. 28B and showing the standby state of the conventional push button switch.
Figure 32B:
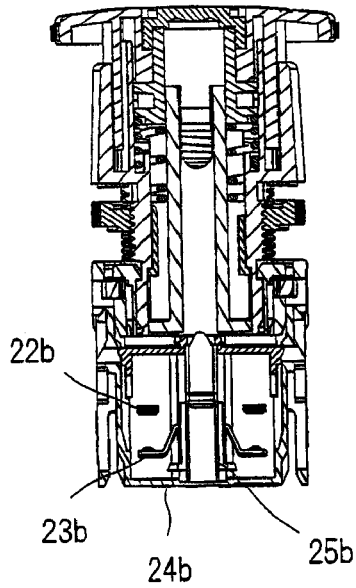
FIG. 32B Prior Art
FIG. 32B is a sectional view likewise showing the operating state of the same.
Figure 33:
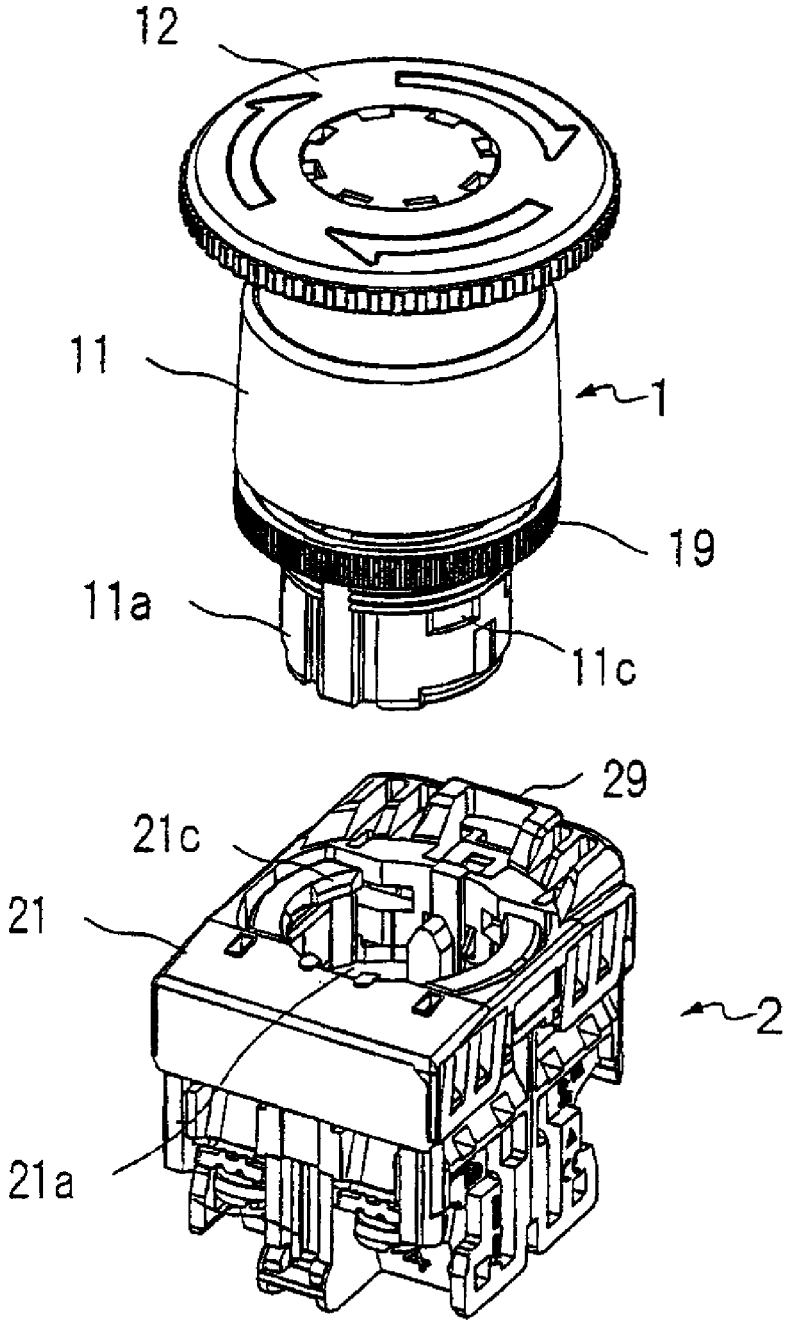
FIG. 33 Prior Art
FIG. 33 is a perspective view showing a state where an operation portion and a switch portion of the conventional push button switch have been separated.
Figure 34:
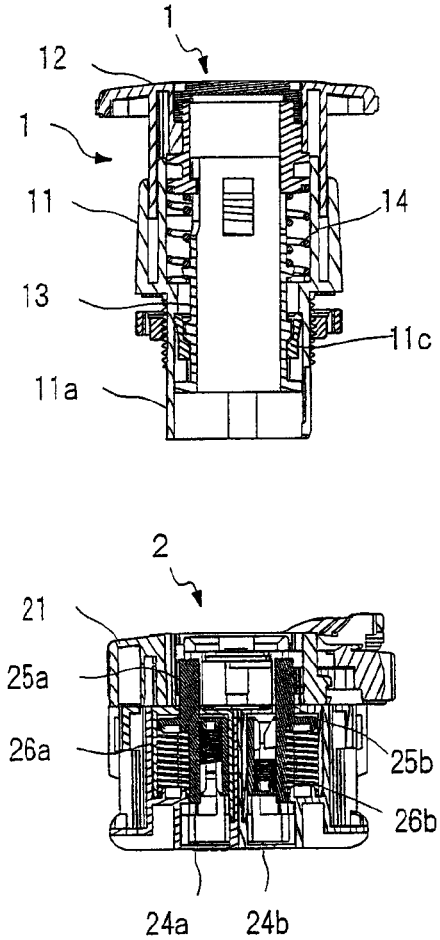
FIG. 34 Prior Art
FIG. 34 is a sectional view taken on cutting line XIX-XIX in FIG. 28B and showing the state where the operation portion and the switch portion of the conventional push button switch have been separated.
Figure 35:
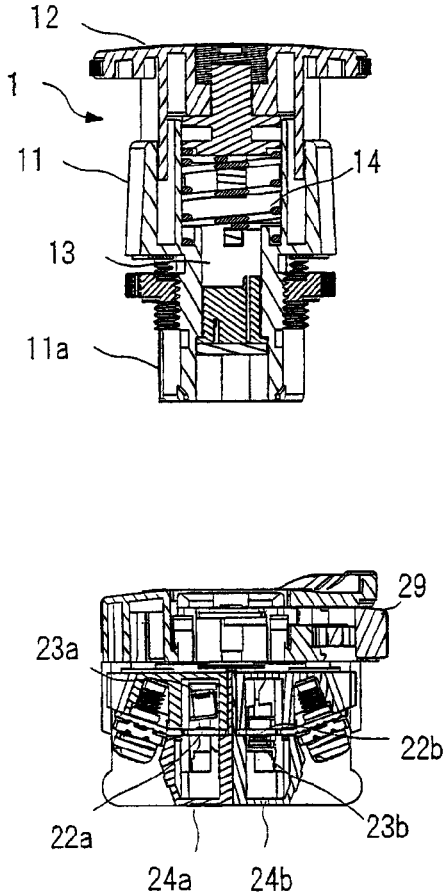
FIG. 35 Prior Art
FIG. 35 is a sectional view taken on cutting line XX-XX in FIG. 28B and showing the state where the operation portion and the switch portion of the conventional push button switch have been separated.
Figure 36:
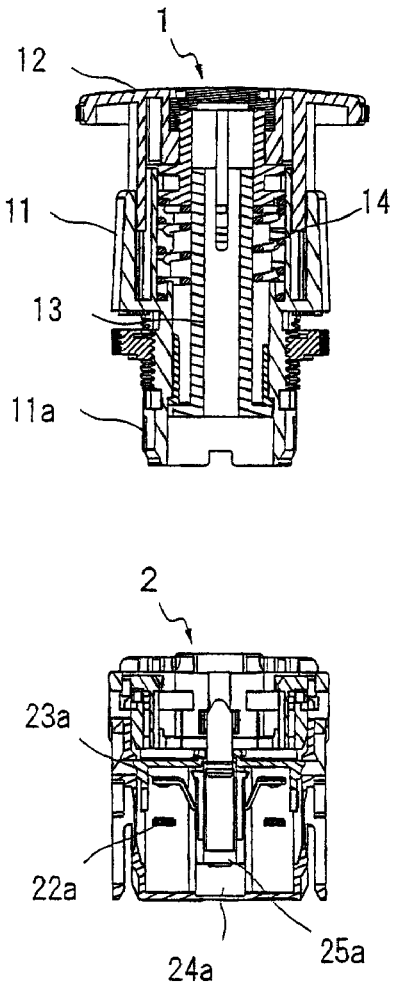
FIG. 36 Prior Art
FIG. 36 is a sectional view taken on cutting line XXI-XXI in FIG. 28B and showing the state where the operation portion and the switch portion of the conventional push button switch have been separated.
Figure 37:
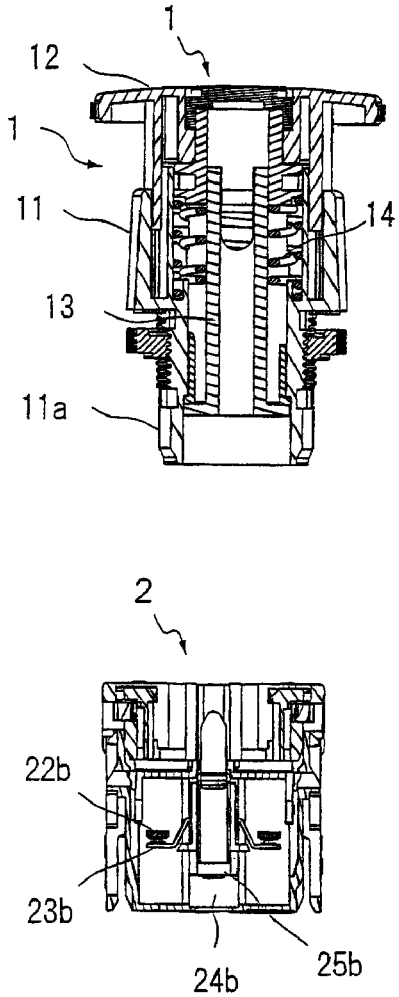
FIG. 37 Prior Art
FIG. 37 is a sectional view taken on cutting line XXII-XXII in FIG. 28B and showing the state where the operation portion and the switch portion of the conventional push button switch have been separated.
Figure 38:
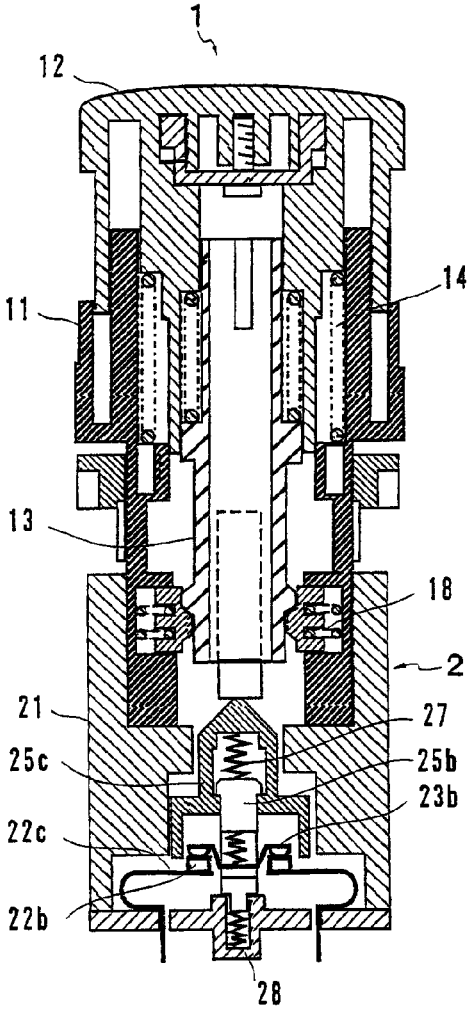
FIG. 38 Prior Art
FIG. 38 is a longitudinally sectional view showing a standby state of another conventional push button switch.
Figure 39:
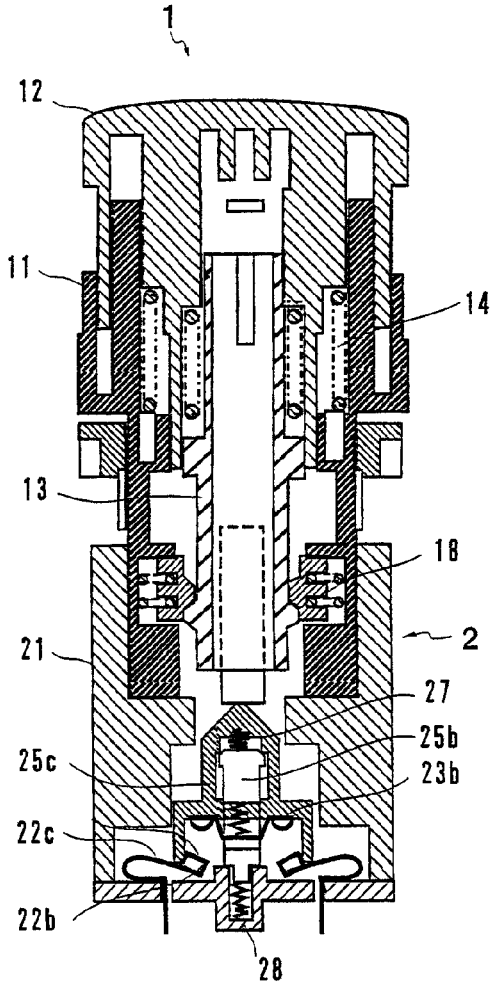
FIG. 39 Prior Art
FIG. 39 is a longitudinally sectional view showing an operating state of another conventional push button switch.
Figure 40:
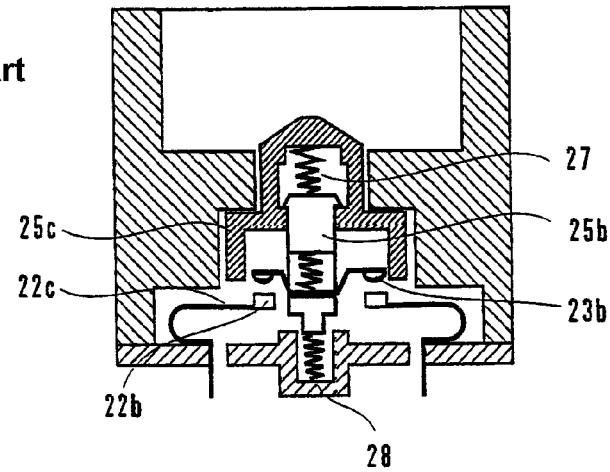
FIG. 40 Prior Art
FIG. 40 is a longitudinally sectional view showing a switch portion which has dropped off an operation portion in another conventional push button switch.
Figure 41:
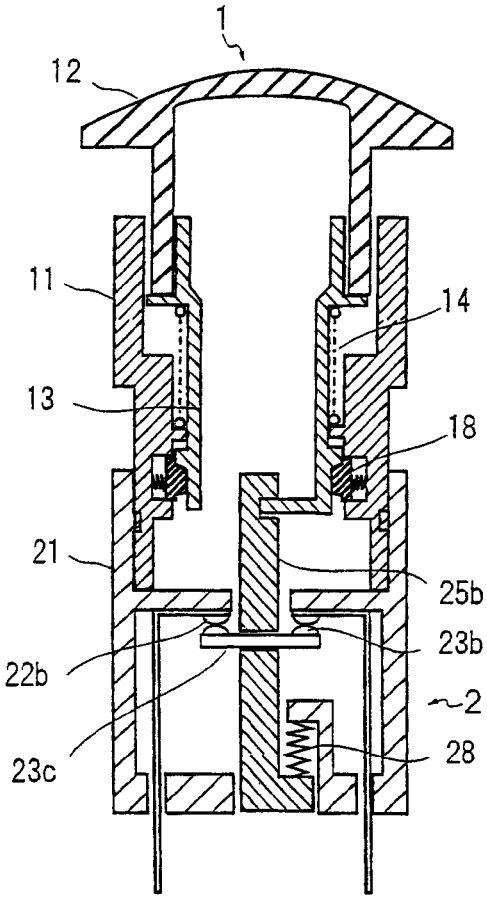
FIG. 41 Prior Art
FIG. 41 is a longitudinally sectional view showing a standby state of further another conventional push button switch.
Figure 42:
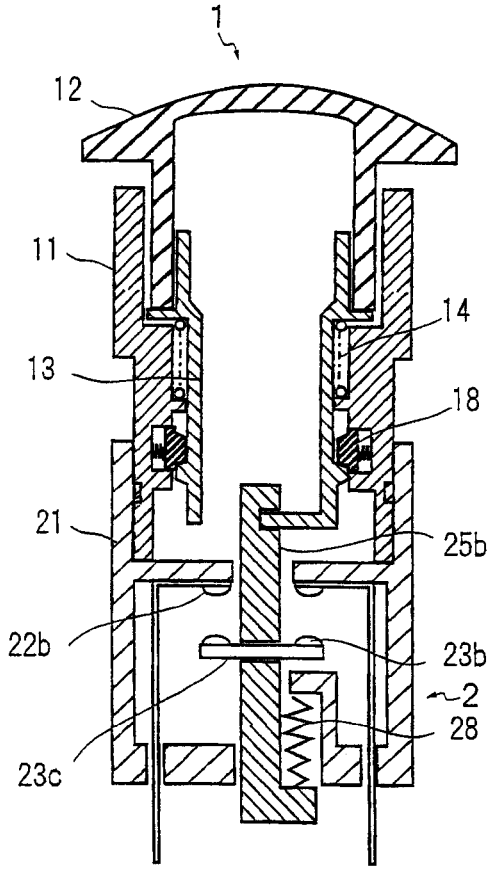
FIG. 42 Prior Art
FIG. 42 is a longitudinally sectional view showing an operating state of further another conventional push button switch.

FIGS. 27A to 27C show a seventh embodiment of the invention in which the structure according to the fifth embodiment is partially changed.

According to the sixth embodiment, the engagement protrusions 44*c* are formed in the relay terminal fittings 44 provided in the switching contact units 24 of the switch portion 2, and when the switch portion 2 is incorporated into the base 42 of the operation box 4, the engagement protrusions 44*c* are pressed into the grooves of the terminal bases 42*d* of the base so as to retain and hold the switching contact units 24 in the temporary assembling positions. On the other hand, in the seventh embodiment, a switch portion attachment frame (resin molding) 46 having a simple structure is placed in the bottom portion of the base 42, and the switching contact units 24 fitted into the attachment frame 46 are snap-fit connected to the attachment frame 46 so as to be retained and fixed to the assembling positions.

That is, retaining fitting cavities 24*v* are provided in left and right side surfaces of an outer frame in each switching contact unit 24 of the switch portion 2 as shown in the first embodiment (see FIGS. 1A and 1B) and the fifth embodiment (see FIG. 22). Accordingly, in the seventh embodiment, screw bases 46*a* are formed in the attachment frame 46 as shown in FIG. 27B. The attachment frame 46 is fixed to the center of the bottom portion of the base 42 through attachment screws 46*b* inserted into the screw bases 46*a*. In addition, the terminal bases 42*d* for supporting the front end portions of the relay terminal fittings 44 provided in the switching contact units 24 are formed integrally in the inside of the base 42 with the attachment frame 46 interposed therebetween, in the same manner as in the fifth embodiment. The relay terminal fittings 44 are fitted into vertical grooves 42*d*-1. Engagement protrusions 46*c* corresponding to fitting cavities 24*v* (see FIG. 27A) provided in the switching contact units 24 are formed in the left and right edges of the attachment frame 46.

When the assembly of the switch portion 2 is pressed into the attachment frame 46 from above in the aforementioned configuration, the retaining fitting cavities 24*v* provided in the switching contact units 24 are fitted into the engagement protrusions 46*c* of the attachment frame 46 respectively to thereby snap-fit connect the switching contact units 24 and the attachment frame 46 to each other. In this manner, the switch portion 2 is retained and fixed to the predetermined position. In addition, the attachment frame 46 is simple in structure and can be produced inexpensively in comparison with the terminal base 43 according to the fifth embodiment.

The invention has been described with reference to certain preferred embodiments thereof. It will be understood, however, that modifications and variations are possible within the scope of the appended claims.

What is claimed is:

1. A push button switch comprising:

an operation portion including a push button to be subjected to a push-in operation; and a switch portion, removably coupled with the operation portion, the switch portion including a switching contact unit whose contacts are opened/closed in connection with the push-in operation of the push button of the operation portion;

wherein the switch portion includes a contact opening mechanism including a lever which is rotatably supported and has one end acting on a part of the operation portion coupled with the switch portion and the other end acting on a contact switching mechanism of the switching contact unit in the switch portion so as to operate to open/close contacts, and a spring which urges the lever in a fixed rotation direction; and wherein the contact switching mechanism of the switching contact unit is urged to move a movable contact from a standby state position toward an operating state position by the contact opening mechanism when the switch portion is separated from the operation portion, while the contact switching mechanism of the contact unit is released from urging when the switch portion is coupled with the operation portion.

2. The push button switch according to claim 1, wherein the lever in the contact opening mechanism has a rotary fulcrum in an intermediate portion thereof, an urging force in one end of the lever acts on the operation portion while an urging force in the other end of the lever acts on a contact portion, and when the switch portion is coupled with the operation portion, the urging force of the lever is borne by the operation portion so that the urging force is prevented from acting on the switch portion.

3. The push button switch according to claim 1, wherein the spring which urges the lever of the contact opening mechanism in the fixed rotation direction comprises a torsion coil spring.

4. The push button switch according to claim 1, wherein the spring which urges the lever of the contact opening mechanism in the fixed rotation direction comprises a compression coil spring.

5. The push button switch according to claim 1, wherein when the operation portion and the switch portion has been coupled with each other, a push rod working with the push button in the operation portion and a movable frame supporting the movable contact forming the switching mechanism of the contact unit in the switch portion are brought into contact with each other in their opposed end portions so as to transfer an operating force therebetween.

6. The push button switch according to claim 1, wherein when the switch portion leaves the operation portion in the case where the switching contact unit has normally open contacts, a displacement of the normally open contacts caused by the switching mechanism of the contact unit urged to close the normally open contacts by the contact opening mechanism is limited not to allow the movable contact to contact with the fixed contact.

7. The push button switch according to claim 1, wherein one or plural switching contact units are provided in the switch portion, and the contact opening mechanism is provided for each switching contact unit.

8. The push button switch according to claim 1, wherein the switching contact unit provided in the switch portion may have plural sets of switching contacts and a common movable frame collectively holding movable contacts of the respective sets of switching contacts, and the contact opening mechanism is provided in connection to the switching contact unit.

9. The push button switch according to claim 1, wherein when the push button is received in a box divided into a base and a cover, the switch portion is fixed to the base while the operation portion is attached to the cover, and the base is covered with the cover to be coupled integrally so that the operation portion and the switch portion can be coupled.

10. The push button switch according to claim 1, wherein when the push button switch is received in a box divided into a base and a cover so as to form a box-mounted push button switch, the operation portion is attached to the cover, the switch portion is fitted into the base to be temporarily retained in a predetermined reception position, and the base is covered with the cover to be coupled integrally so that the operation portion and the switch portion can be coupled while the switch portion can be held and fixed by the cover and the base from above and below.

11. The push button switch according to claim 10, wherein relay terminal fittings with terminal screws are provided so that one end of each relay terminal fitting is connected to a corresponding one of leading-out terminals provided in the switching contact unit of the switch portion while the other end thereof is led out to an upper surface side of the base of the box, and in a state where the base has been covered with the cover of the box to be coupled integrally, the relay terminal fittings are interposed between terminal bases formed in the base and press ribs formed on an inner side of the cover so that the switch portion can be held and fixed.

12. The push button switch according to claim 11, wherein the terminal fittings are pressed into grooves of the terminal bases formed in the base of the box so that the switch portion can be temporarily fixed.

13. The push button switch according to claim 10, wherein a switching portion attachment frame is provided in a bottom portion of the base of the box and the switch portion is fitted into the attachment frame to be snap-fit connected thereto.

* * * * *